US006912181B2

(12) United States Patent
Maruyama et al.

(10) Patent No.: US 6,912,181 B2
(45) Date of Patent: Jun. 28, 2005

(54) ELECTRONIC TIMEPIECE WITH CONTROLLED DATE DISPLAY UPDATING

(75) Inventors: Akihiko Maruyama, Suwa (JP); Akihiro Sawada, Matsumoto (JP)

(73) Assignee: Seiko Epson Corporatioin, Tokyo (JP)

( * ) Notice: Subject to any disclaimer, the term of this patent is extended or adjusted under 35 U.S.C. 154(b) by 0 days.

(21) Appl. No.: 10/371,749

(22) Filed: Feb. 21, 2003

(65) Prior Publication Data

US 2003/0165083 A1 Sep. 4, 2003

(30) Foreign Application Priority Data

Feb. 28, 2002 (JP) ..... 2002-054862

(51) Int. Cl.[7] ..... G04C 3/00; G04C 23/00; G04B 1/00

(52) U.S. Cl. ..... 368/203; 368/64; 368/66; 368/204

(58) Field of Search ..... 368/28–29, 64–66, 368/203–204

(56) References Cited

U.S. PATENT DOCUMENTS 4,615,625 A * 10/1986 Moriya ..... 368/156
6,240,052 B1 5/2001 Kitajima et al.
6,320,822 B1 * 11/2001 Okeya et al. ..... 368/66
6,424,600 B1 * 7/2002 Okeya et al. ..... 368/204
6,483,781 B2 * 11/2002 Igarashi et al. ..... 368/66
2001/0028606 A1 * 10/2001 Fujisawa ..... 368/204

FOREIGN PATENT DOCUMENTS

JP 11-190781 7/1999

* cited by examiner

*Primary Examiner*—Randy W. Gibson
*Assistant Examiner*—Michael L. Lindinger
(74) *Attorney, Agent, or Firm*—Mark P. Watson

(57) ABSTRACT

An electronic timepiece without system failure at the time of transfer from the power-saving mode to the display mode is provided. A power-saving control circuit 400 controls drive of a date dial displaying a date when updating a date display, which has been stopped in a power-saving mode, to a current date at the time of transfer from the power-saving mode to the display mode. The power-saving control circuit 400 outputs a date dial drive inhibiting signal, which prohibits drive of the date dial 75, to a date-updating control circuit 300, if a voltage VDD of a power source unit B is less than or equal to a low threshold voltage V1. It outputs a date dial deceleration driving signal, which drives a date dial 75 with a predetermined speed slower than a normal update speed when transferring to the display mode, to a date-updating control circuit 300, if a source voltage VDD is equal to or less than a high threshold voltage V2.

41 Claims, 11 Drawing Sheets

ELECTRONIC TIMEPIECE WITH CONTROLLED DATE DISPLAY UPDATING

BACKGROUND OF THE INVENTION

1. Field of the Invention

The present invention relates to an electronic timepiece that is provided with a power-saving function and a mechanism for displaying a date.

2. Description of the Related Art

A mobile-type electronic timepiece (e.g. wristwatch) provided with a time display mechanism that displays the time and a date display mechanism that displays the date is conventionally known. Furthermore, in this kind of electronic timepiece, there is a type having a function where a display mode, in which the current time and present date is displayed, is changed to a power-saving mode, in which power consumption is saved in response to a detected state or condition (e.g. when the timepiece, such as a kinetic watch, is not worn by a person and therefore is not being charged for a specified period of time). In such an electronic timepiece, the time display mechanism and a date display mechanism are driven if the timepiece is worn by a user and power is generated by motion of the user, but driving of each mechanism is stopped by a power-saving mode and power is saved when the watch is not worn. Further, an electronic circuit updates the time and date if the user resumes wearing of the watch after a non-used state is detected for a specific time.

However, at the time of transition from a power-saving mode to a display mode, both the time display mechanism and the date display mechanism, which were stopped at the time of transition to the power-saving mode, are driven so that voltage drop in the power source occurs. Hence, there is a problem in that a loss in system functionality can result from the occurrence of such voltage drop, which leads to the display of the wrong time or date.

OBJECTS OF THE INVENTION

In view from the above-mentioned problem, an object of the invention is to provide an electronic timepiece where a loss of system functionality does not occur at the time of transition from the power-saving mode to the display mode.

SUMMARY OF THE INVENTION

The present invention provides an electronic timepiece comprising: a power source; a power-saving unit that suspends supply of power from the power source under a predetermined power-saving condition; a hand-driving unit that drives hands that indicate second, minute and hour by receiving power from the power source; a date unit that indicates displayed calendar information comprising at least one of year, month, and day; a date driving unit that drives the date unit by receiving power from the power source; a date updating unit that updates current calendar information comprising at least one of year, month, and day, while the power-saving unit suspends the supply of power; and a control unit that, upon termination of suspension of the supply of power by the power-saving unit, controls the date driving unit to drive the date unit so that the displayed calendar information coincides with the current calendar information, the control unit being responsive to at least one predetermined timepiece condition for setting a speed of driving of the date unit.

By setting the speed of driving of the date unit when transferring from the power savings mode to the display mode, a timepiece system failure can be avoided under certain conditions.

In a particular aspect, the electronic timepiece further comprises a voltage detection unit that detects an output voltage of the power source; and the detected output voltage comprises the at least one predetermined timepiece condition.

In this aspect, by detecting the voltage of the power source and controlling the speed of driving of the date unit on that basis, timepiece failure can be prevented if the voltage is too low at the time of transfer to display mode by reducing the speed of driving or stopping driving to reduce or eliminate power consumption for updating the calendar display.

More specifically, in the present invention, the control unit is responsive to the detected output voltage being less than or equal to a low threshold voltage (V1) for setting the speed of driving of the date unit to zero, thereby prohibiting driving of the date unit. Thus the large voltage drop that occurs from quickly driving the calendar (date) display is avoided when the power source voltage is already low.

In another aspect of the present invention, the control unit is responsive to the detected output voltage being greater than a high threshold voltage (V2) for setting the speed of driving of the date unit to a normal date-update driving speed, and the control unit is responsive to the detected output voltage being less than or equal to a low threshold voltage (V1) for setting the speed of driving of the date unit to zero, thereby prohibiting driving of the date unit, the low threshold voltage being less than the high threshold voltage.

Thus, if the power supply voltage is greater than a high threshold voltage (V2), there is no danger of a system failure (i.e. the watch indicating the wrong time) and the date display can be quickly driven to the correct current date at the time of transfer to the display mode.

In a further aspect, the control unit is responsive to the detected output voltage being greater than a high threshold (V2) voltage for setting the speed of driving of the date unit to a normal date-update driving speed, and the control unit is responsive to the detected output voltage being less than or equal to the high threshold voltage for setting the speed of driving of the date unit to a decelerated date-update driving speed, the decelerated date-update driving speed being slower that the normal date-update driving speed.

Thus, if the power supply voltage is below a certain high threshold value but not as low as the low threshold value, driving of the date display is performed at a slower speed (lower frequency) to reduce power consumption and prevent system failure.

In another aspect of the present invention, the control unit, upon termination of suspension of the supply of power by the power-saving unit, determines the difference in number of days between the displayed calendar information and the current calendar information and the determined difference comprises the at least one predetermined timepiece condition.

Thus, if the number of days that the date display must be driven forward to make it coincide with the current date is greater than a threshold number, driving of the date display is performed at a slower speed (lower frequency) to reduce power consumption and prevent system failure.

In another aspect of the present invention, an electronic timepiece comprises: a power source; a power-saving unit that suspends supply of power from the power source under a predetermined power-saving condition; a hand-driving unit that drives hands that indicate second, minute and hour by receiving power from the power source; a date unit that indicates displayed calendar information comprising at least one of year, month, and day; a zero time (0:00) detector that detects a zero time (0:00) position of the hands and outputs a zero time (0:00) detection signal; a 24 hours-timekeeping unit that counts time and outputs a 24-hours signal as each 24 hour time period elapses; a reset unit that outputs a reset signal after a system resetting; a control unit that resets the 24 hours-timekeeping unit following a first zero time (0:00) detection signal following the reset signal; a date driving unit that drives the date unit, the control unit controlling the date driving unit to drive the date unit and advance the date in response to a first zero time (0:00) detection signal following the reset signal, and thereafter controlling the date driving unit to drive the date unit and advance the date in response to each 24-hours signal.

According to this aspect, the date unit is driven by the 24 hours-timekeeping unit even during a power saving mode in which the hands are not driven. So, when the timepiece transfers back to the display mode, it is not necessary to drive the date unit, which limits the voltage drop at transfer time and prevents a system failure. A system resetting can occur, for example, when a battery is changed.

In yet a further aspect, a precondition of the power-saving unit suspending supply of power from the power source is reception of a first zero time (0:00) detection signal following the reset signal.

Thus, the 24 hours-timekeeping unit is reset before stopping power to the hand driving unit so that the output timing of the 24-hours signal coincides with the timing of the zero time (0:00) detection signal so that the date unit can be driven accurately even after stopping power supply to the hands-driving unit.

In another aspect of the present invention, an electronic timepiece comprises: a power source; a power-saving unit that suspends supply of power from the power source under a predetermined power-saving condition; a hand-driving unit that drives hands that indicate second, minute and hour by receiving power from the power source; a 24 hours-timekeeping unit that counts time and outputs a 24-hours signal as each 24 hours elapses; a reset unit that outputs a reset signal and resets the 24 hours-timekeeping unit; and a precondition of the power-saving unit suspending supply of power from the power source is reception of a 24-hours signal following the reset signal.

Thus, power supply to the hand driving unit is not stopped until the time when 24 hours has elapsed following the reset signal. Hence the hands will surely pass the 0:00 position before stopping power and the output timing of the 24-hours signal will coincide with the output timing of the zero time (0:00) detection signal so that the date unit can be driven accurately.

The present invention also provides methods of operating a timepiece commensurate with the apparatus described above.

DESCRIPTION OF THE PREFERRED EMBODIMENTS

Preferred embodiments of the invention will be described with reference to the drawings.

A first embodiment is described as follows.

Figure 11:
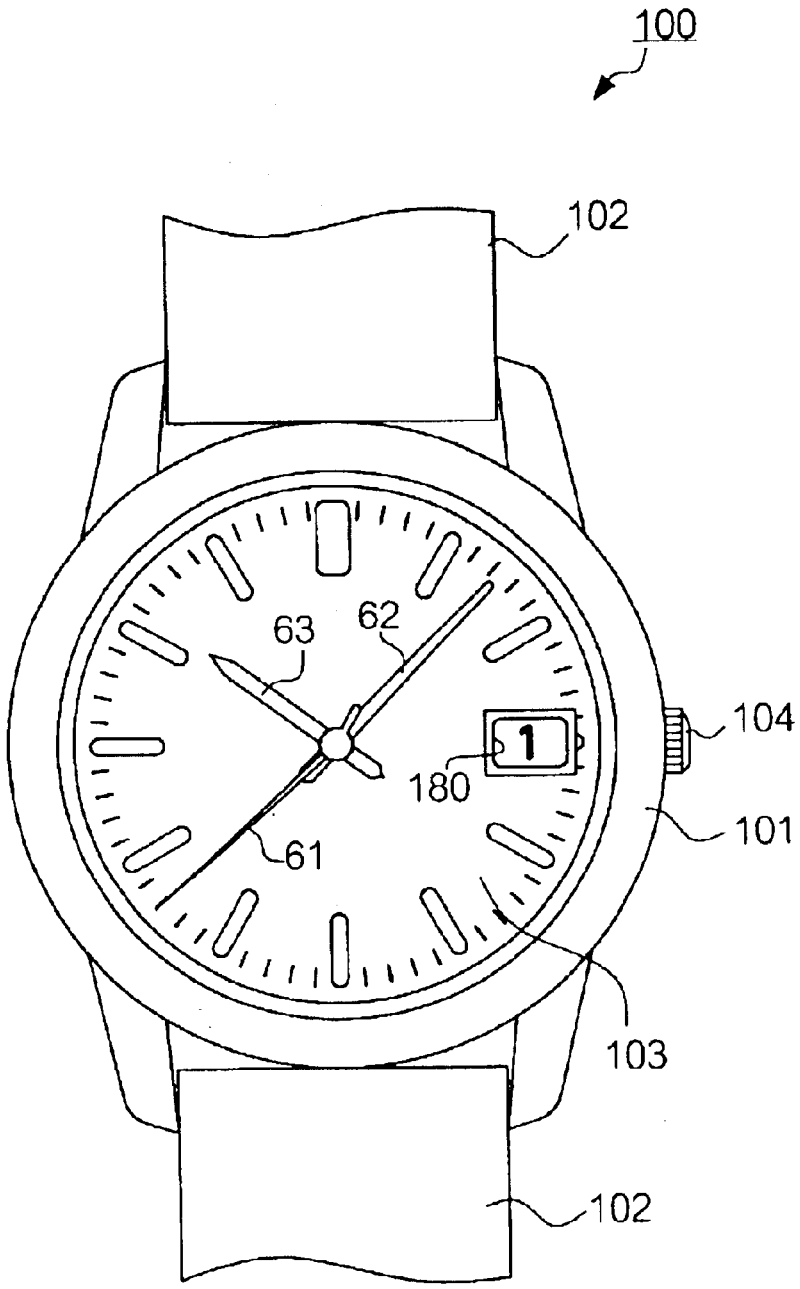
FIG. 11 is a schematic diagram of the electronic timepiece according to the first embodiment.

Firstly an overview of an electronic timepiece regarding to the first embodiment will be explained with reference to FIG. 11. An electronic timepiece 100 can be an analog wristwatch, for example, which is used by being fastened to an arm (wrist) of a user via a band 102, as indicated in this figure. In addition, a circular time indicator panel 103 is provided in a main body 101 of the electronic timepiece 100. The time indicator panel 103 is provided with a scale for showing hour, minute and second along with its circumference and time is displayed by indicating hands composed of a second hand 61, a minute hand 62 and a hour hand 63 which are installed above (in the direction out of the page) the time indicator panel 103. In addition, a date display window 180 is arranged on the right side of the time indicator panel 103 in the figure and the day's date is displayed as a number in the range from "1" to "31". In addition, on the right side of the main frame 101, a crown 104 is arranged. A user can adjust hour and minute, and adjust the date displayed in the date display window 180 by rotating the crown 104 after it is pulled out (to the right side in the figure).

Here, the electronic timepiece 100 in the present embodiment is provided with two operation modes: a display mode and a power-saving mode. Of these, the display mode is an operation mode in which display of the current time and date result from driving a mechanical display mechanism. On the other hand, the power-saving mode is an operation mode in which power is saved by stopping drive of the display mechanism when the electronic timepiece 100 detects that a user is not carrying the watch (e.g. no motion results in no power being generated in a kinetic watch). When the electronic timepiece 100 detects usage (e.g. carrying by a user) during the power-saving mode, the mode is transferred to the display mode and display mechanism is driven quickly in order to update the time and date indicators to display the current time and date.

Figure 1:
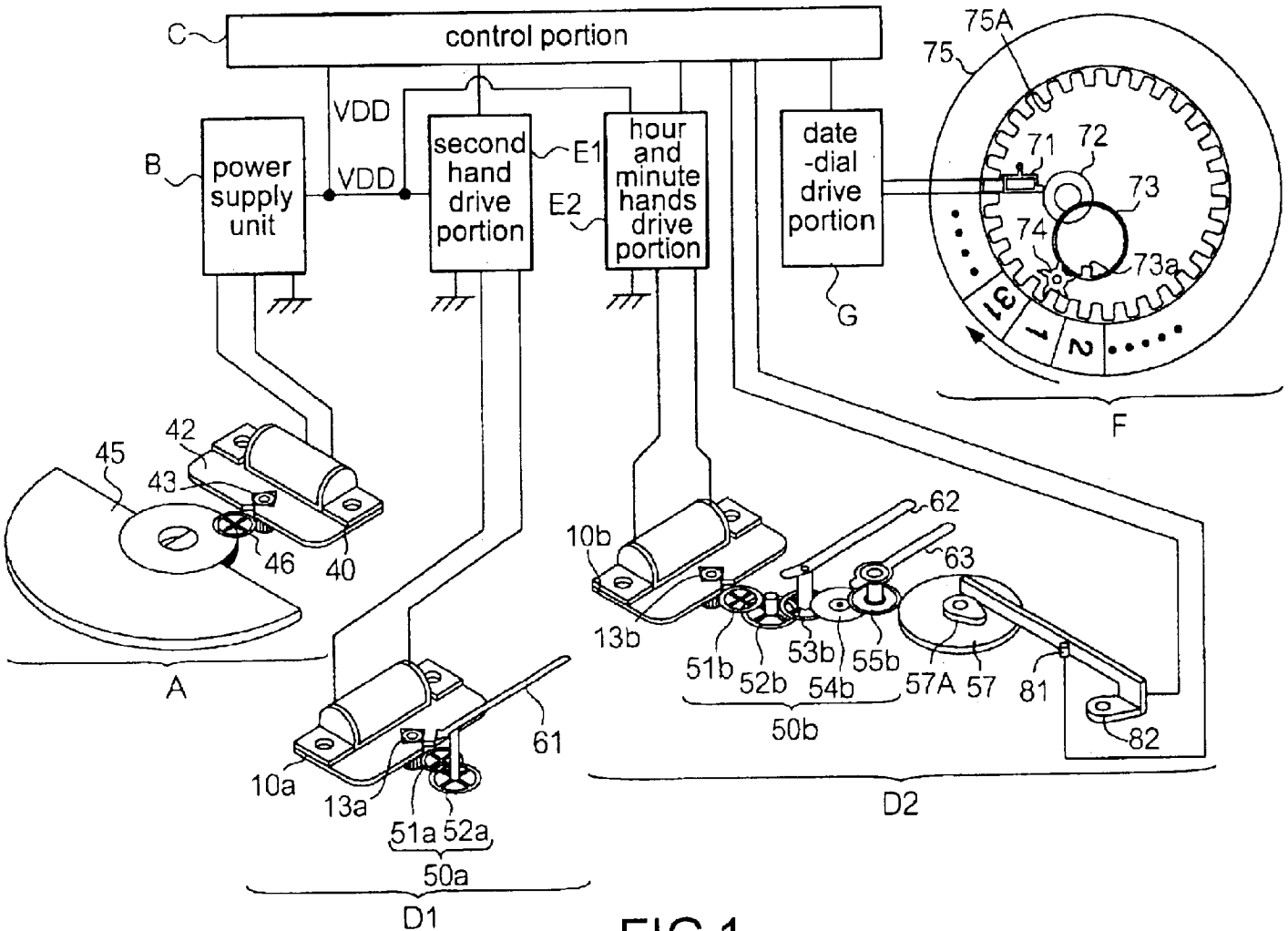
FIG. 1 is a schematic diagram of an electronic timepiece according to the first embodiment of the present invention.

FIG. 1 shows the basic structure of the electronic timepiece 100. As shown in this figure, the electronic timepiece

100 comprises a power generation portion A that generates electricity, a power supply unit B that is charged by current supplied from the power generation portion A and which supplies electric power to each portion of the electronic timepiece 100, a control portion C that controls each structural portion, a second hand mechanism D1 that drives a second hand 61, a second hand drive portion E1 that drives the second hand mechanism D1 in response to control of the control portion C, an hour and minute hands mechanism D2 that drives a minute hand 62 and a hour hand 63, an hour and minute hands drive portion E2 that drives the hour and minute hands mechanism D2 in response to control of the control portion C, a date dial mechanism F that updates a date display, and a date-dial drive portion G that drives a date dial mechanism F in response to control of the control portion C.

The power generation portion A is provided with a rotating weight 45 that rotates to capture the movement of a user's arm in normal use when the electronic timepiece 100 is worn on a user's wrist. The rotating force of this rotating weight 45 is transmitted to a power-generation rotor 43 via a speed-increasing gear 46. In a power generator 40, the power-generation rotor 43 rotates inside of a power-generation stator 42 so that electromagnetic induction is generated. Hence, alternating current occurs. The control portion C detects the state of use of the electronic timepiece 100 if the power generation portion A generates electricity, and detects the state of out of use of the electronic timepiece 100 if the power generation portion A does not generate electricity during a specific term (e.g. if the watch is not worn or there is no movement for a given period of time).

A power supply unit B comprising a rectifier circuit, a second power and a boosting voltage circuit, charges current supplied from power generation portion A and applies a power source voltage VDD to each structural portion of the electronic timepiece 100. Here, the power supply unit B refers to VSS (the low amplitude side) as a reference potential (GND).

The control portion C controls updating of the display by the date dial mechanism F with reference to a calendar in the display mode, and controls transfer from the display mode to the power-saving mode and, when the power-saving mode is changed to the display mode, updates the date which was stopped at the time of transfer to the power-saving mode. Details will be described thereafter.

The second hand drive portion E1 generates various driving pulses under control of control portion C and outputs them to a second hand mechanism D1. The second hand mechanism D1 is provided with a second motor 10*a* that drives the second hand in response to a driving pulse input from the second hand drive portion E1. This second motor 10*a* rotates a rotor 13*a* in response to a driving pulse. Rotation of the rotor 13*a* is transmitted to a second hand 61 by a second gear train 50*a* comprising a second intermediate wheel 51*a* and a second wheel 52*a*, which are engaged with the rotor 13*a*. In this way, a second hand 61 is driven forward, in conjunction with rotation of the rotor 13*a*, and displays time (in seconds).

The hour and minute hands drive portion E2 generates various driving pulses under control of control portion C and outputs them to the hour and minute hands mechanism D2. The hour and minute hands mechanism D2 is provided with an hour and minute motor 10*b* that drives the hour and minute hands in response to a driving pulse input from the hour and minute hands drive portion E2. The hour and minute motor 10*b* rotates a rotor 13*b* in response to input of a driving pulse. Rotation of the rotor 13*b* is transferred to the minute hand 62 and the hour hand 63 by the gear train portion 50*b* comprising a fourth wheel 51*b* that is engaged with the rotor 13*b*, a third wheel 52*b*, a second wheel 53*b*, a back side date wheel 54*b* and a hour wheel 55*b*. In this way, each of the minute hand 62 and the hour hand 63 is driven forward, in conjunction with rotation of the rotor 13*b*, and displays time (hour and minute).

A 24 hours wheel 57 that is engaged with the hour wheel 55*b*, rotates once every 24 hours and moves a switch pin 81 away from a switch shaft 82 at the time of 24:00 (0:00 in the morning or 12:00 pm). The switch pin 81 is normally in closed contact with shaft 82 but it is moved via a cam 57A installed on the 24 hours wheel 57 to the opened (off) state. Thus, the control portion C detects that current time becomes "0:00" and controls the date-dial drive portion G in order to update the date display.

The date-dial drive portion G applies an alternate current voltage to an actuator 71, included in the date dial mechanism F, in order to drive a date dial 75 each time that the switching pin 81 is removed from the switch shaft 82. The date dial 75, which displays a date for one day, has a ring shape and is provided with equally spaced numbers from "1" to "31" indicating a date. In addition, the date dial 75 is arranged in the main body 101 so that one of numbers is displayed in a date display window 180 installed in the time indicator panel 103. The actuator 71 oscillates in the direction parallel to the page when voltage is applied to it. Oscillating movement of the actuator 71 is transferred to the date dial 75 via a rotor 72, a Geneva wheel 73 for controlling drive of the date wheel and a date-turning wheel 74 so that the date dial 75 is rotatively driven. In detail, the outer circumferential face of the rotor 72 is contacted by oscillation of the actuator 71 so that the rotor 72 is rotatively driven. When the rotor 72 rotates, the Geneva wheel 73 for controlling drive of the date wheel that is engaged with the rotor 72 rotates. When the Geneva wheel 73 for controlling drive of the date wheel rotates, the date turning wheel 74, which is engaged with a cam portion 73*a* installed in the Geneva wheel 73, rotates and the date dial 75 is rotated in a clockwise direction via a tooth portion 75A. Hence, a date displayed in a date display window 180 is changed by rotation of the date dial 75.

Figure 2:
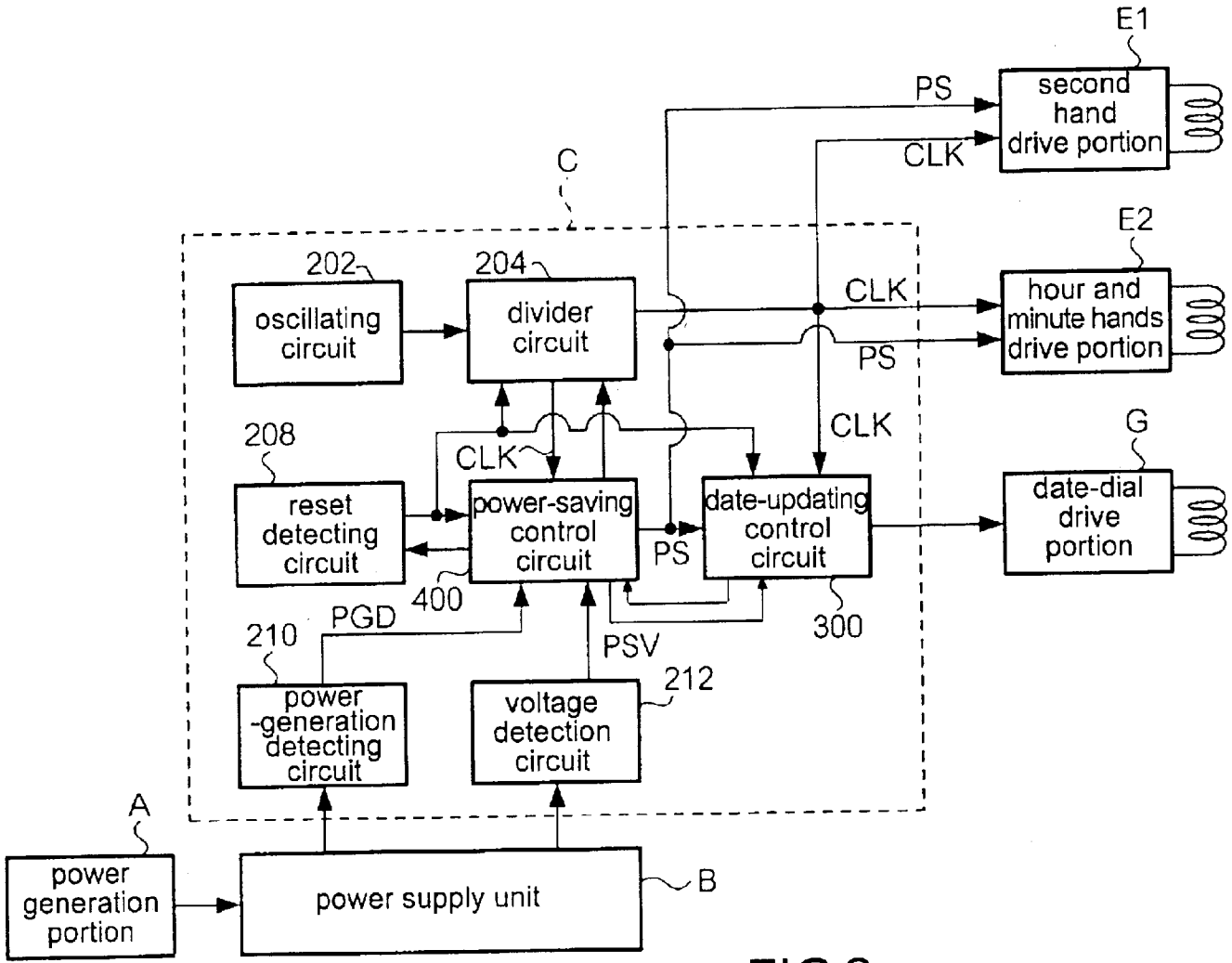
FIG. 2 is a functional block diagram of a control portion of the electronic timepiece and related function units according to the first embodiment of the present invention.

Next, the control portion C will be described. FIG. 2 shows a functional block diagram of the control portion C and related functional units. As shown in this figure, the control portion C is provided with an oscillating circuit 202. The oscillating circuit 202 is provided with a crystal resonator and outputs an oscillation signal to a divider circuit 204. The divider circuit 204 divides the inputted oscillation signal and supplies various clock signals CLK having a clock signal of frequency 1 Hz, for example. These various clock signals CLK are supplied to a power-saving control circuit 400, a date-updating control circuit 300, the second hand drive portion E1 and the hour and minute hands drive portion E2.

When the second hand drive portion E1 receives a clock signal CLK from the divider circuit 204, it produces a driving pulse signal in synchronization with a clock signal CLK and outputs this signal to the second motor 10*a* included in the second hand mechanism D1. Hence, the second motor 10*a* is driven thereby and the second hand 61 is driven forward. In addition, the hour and minute hands drive portion E2 produces a driving pulse signal which synchronizes with the clock signal CLK, when it a clock signal CLK is input from the divider circuit 204, and outputs the signal to the hour and minute motor 10*b* included in the hour and minute hands mechanism D2. Hence, the hour and minute motor 10*b* is driven thereby and the minute hand 62 and the hour hand 63 are driven forward.

A power-generation detecting circuit 210 detects whether the power generation portion A is in the state of power generation or not via the rectifier circuit included by a power supply unit B. Hence, if it is in the power generation state, a power-generation detecting signal PGD is input into the power-saving control circuit 400. In addition, a voltage detection circuit 212 detects source voltage VDD of the power supply unit B and receives it to the power-saving control circuit 400 as a source voltage signal PSV.

A reset detecting circuit 208 detects operation of the crown 104 operated by a user. In detail, when the reset circuit 208 detects pulling the crown 104, it transmits a hand drive stop signal to the divider circuit 204. When the divider circuit 204 receives the hand drive stop signal, it stops supply of a clock signal CLK to the second hand drive portion E1 and the minute hand drive portion E2. Hence, forward drive of each of the hands is stopped. Under this circumstance, a user adjusts the displayed time indicated by the minute hand 62 and the hour hand 63 by rotating the crown 104.

Further, when the reset detecting circuit 208 detects pushing in of the crown 104 (by a user), it transmits a reset signal to the date-updating control circuit 300 and the power-saving control circuit 400 which will be explained hereafter. When the date-updating control circuit 300 and the power-saving control circuit 400 receive the reset signal from the reset detecting circuit 208, counting values of various counters are reset. Further, when the reset detecting circuit 208 detects pushing the crown 104, it transmits a hand-drive starting signal to the divider circuit 204. When the divider circuit 204 receives the hand-drive starting signal from the reset detecting circuit 208, it starts to supply the clock signal CLK to the second hand drive portion E1 and the hour and minute hands drive portion E2. Hence, forward drive of each of the hands is started again. Thus, when the crown 104 is pushed in, the system is reset (initialized) in the electronic timepiece 100 and then forward drive of each of hands is started again.

The power-saving control circuit 400 implements various controls with regard to transfer of modes between a display mode and a power-saving mode in response to the power-generation detecting signal PGD. In detail, the power-saving control circuit 400 is provided with a non-power generation time counter that measures the time during which the power-generation detecting signal (non-power generation hour) is not input during the display mode. This non-power generation time counter resets when the power-generation detecting signal PGD is input. The non-power generation time is measured by counting the 1 Hz signal input from the divider circuit 204. When the time measured by the non-power generation time counter reaches a predetermined time (for example, 12 hours) in the display mode, the power-saving control circuit 400 transfers the operation mode to the power-saving mode. Here, the power-saving control circuit 400 outputs a power-saving mode transfer signal PS to each of the second hand drive portion E1, the hour and minute drive portion E2 and the date-updating control circuit 300. This signal PS stops the driving of each of the second hand mechanism D1, the hour and minute hands mechanism D2 and a date dial mechanism F. Thus, voltage is not applied to the hand motor 10*a*, the hour and minute motor 10*b* and the actuator 71 during the power-saving mode, so that power consumption is saved. The power-saving control circuit 400 updates the date and time measured by the counter in the power-saving mode.

Further, when the power-saving control circuit 400 receives the power-generation detecting signal PGD in the power-saving mode, it transfers the operation mode to the display mode, described as follows, in order that the display of the date and time, which were stopped at the time of transfer to the power-saving mode, are effectively changed to the present date.

At first, the power-saving control circuit 400 outputs a display mode transfer signal to the divider circuit 204. When the divider circuit 204 receives the display mode transfer signal, it supplies a clock signal CLK, which period is shorter than a normal clock signal CLK in the display mode, to the second hand drive portion E1. Thus, the second hand 61 is driven rapidly at a velocity faster than the normal velocity in the display mode. Further, when the divider circuit 204 receives the display mode transfer signal from the power-saving control circuit 400, it outputs a clock signal CLK, which period is shorter than a clock signal CLK in the display mode, to the hour and minute hands drive portion E2.

Hence, each of the hour hand 62 and the minute hand 63 is driven rapidly at a velocity faster than the normal velocity in the display mode. Further, the power-saving control circuit 400 is provided with a hand location counter and a coincidence detecting circuit. The hand location counter detects the location of each of the second hand 61, the minute hand 62 and the hour hand 63 and outputs a hand location signal to the coincidence detecting circuit, while each of hands is driven rapidly. The coincidence detecting circuit determines whether the displayed time of each hand, indicated by the hand location signal, coincides with the current time, indicated by the value of the counter, or not, and outputs a coincidence signal to the divider circuit 204, if these coincide with each other. When the divider circuit 204 receives the coincidence signal, it provides the normal clock signal CLK in the display mode to the second hand drive portion E1 and the hour and minute hands drive portion E2. Here, each of hands is driven at the normal speed and current time is displayed thereby.

Thus, when each of hands displays the current time, the power-saving control circuit 400 outputs a control signal to the date-updating control circuit 300. When the date-updating control circuit 300 receives the control signal, it causes the date dial 75, which was stopped at the time of transfer to the power-saving mode, to be driven by the date-dial drive portion G in order to display current date.

At the time of transfer from the power-saving mode to the display mode, each of hands is driven at a rapid speed faster than normal speed so that the displayed time, which was stopped during the power-saving mode, is updated to the current time. Further, a number from "1" to "31" is displayed by the date dial 75. Hence, when a date display, which was stopped in the power-saving mode, is updated to a current date, the date dial mechanism F must drive the date dial forward by "30 days" at maximum in succession. However, such rapid drive of the hands and continuous drive of the date dial forward consumes a great deal of energy. Hence, in the conventional electronic timepiece, where the time display mechanism and a date display mechanism are driven almost simultaneously, power in the power supply unit B is drops by a large amount at the time of transfer from the power-saving mode to the display mode so that the functionality of electronic timepiece can be impaired. Especially, such system degradation can occur easily in the case stored power in the timepiece has been significantly reduced or in cold temperatures.

In contrast, in this embodiment of the present invention, the power-saving control circuit 400 controls driving of the date dial 75 at the time of transfer from the power-saving mode to the display mode in order to prevent loss of system functionality. Namely, the power-saving control circuit 400 controls drive of the date dial 75 in response to (or on the basis of) a level of source voltage VDD of the power supply unit B and/or the total number of days of driving dates forward that is required to reach the current date (in other words, total amounts of drive of the date dial 75).

In detail, when the source voltage VDD indicated by the voltage detection signal PSV is less than or equal to a threshold voltage V1, the power-saving control circuit 400 outputs a signal to the date-updating control circuit 300 that prohibits drive of the date dial 75 in order to avoid loss of system functionality. Further, when the source voltage VDD is less than or equal to a threshold voltage V2, which is higher than the threshold voltage V1, the power-saving control circuit 400 outputs a signal for decelerating the speed (using a lower frequency clock for driving) at which the date dial is updated to the date-updating control circuit 300. This decelerating signal drives the date dial 75 at a slower speed (lower frequency clock) than normal speed (high frequency clock) that would be used at the time of transfer to the display mode.

Here, the threshold voltage V1 is the lower limit of power voltage where there is no possibility of system failure or deterioration even when the date dial 75 is driven with a slower speed than normal speed that is used at the time of transfer to the display mode. In other words, below or at the threshold voltage V1, the timepiece might stop or show the wrong time or date if the date dial is updated at the time of transfer to the display mode. The threshold voltage V2 is the lower limit of power voltage where there is no possibility of system failure or deterioration when the date dial 75 is driven at the normal (updating) speed at the time of the display mode. Remember that the normal updating speed is an accelerated speed (high frequency clock) that quickly advances the date dial to the current date.

Further, if the number of days that the date dial must be driven forward is larger than or equal to a predetermined threshold (for example, this threshold number of days is 10 in an embodiment), the power-saving control circuit 400 outputs the signal for decelerating the speed at which the date dial is updated to the date-updating control circuit 300. As discussed above, this decelerating signal drives the date dial 75 at a slower speed than normal speed that would be used at the time of transfer to the display mode.

Further, when the number of days that the date dial must be driven forward is less than the predetermined threshold and the source voltage VDD is larger than the threshold voltage V2, the power-saving control circuit outputs a signal for normal drive (high frequency clock) of the date dial to the date-updating control circuit 300. This signal for normal drive of the date dial drives the date dial 75 with normal speed at the time of transfer to the display mode, the normal speed at transfer being a high speed as compared to drive of the date dial in typical display mode.

The power-saving control circuit 400 determines the numbers of days that must be driven forward to update the displayed date by comparing the information indicating the current date in the day counter 308 with the information indicating the date being displayed in the day displaying-location counter 316. Both of these values are input from the date-updating control circuit 300, described in detail with reference to FIG. 3. The power-saving control circuit 400 can compare the two day values to produce a difference value that represents the numbers of days that must be driven forward to update the displayed date. This difference value is used by the power-saving control circuit 400, which forms part of control portion or unit C, to control the speed at which the date dial is updated as described hereinafter in greater detail.

The date-updating control circuit 300 controls updating of the displayed date to the actual (current) calendar date during the time display mode. It controls the date dial mechanism F and controls drive of the date dial 75 at the time of transfer from the power-saving mode to display mode in response to various control signals input from the power-saving control circuit 400.

Figure 3:
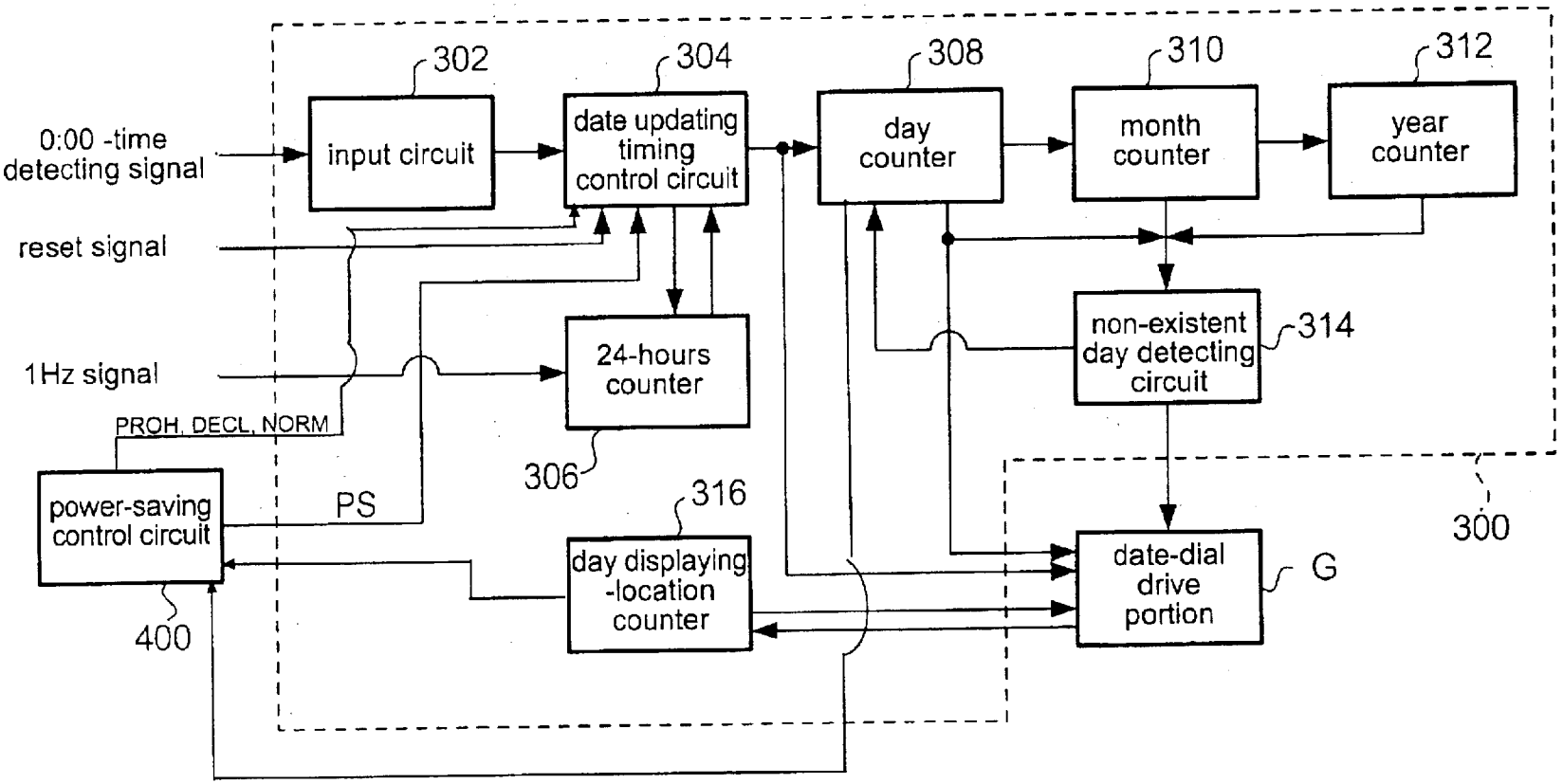
FIG. 3 is a functional block diagram of a date-updating control circuit of the control portion.

FIG. 3 shows a block diagram of the date-updating control circuit 300. In this diagram, an input circuit 302 receives a 0:00-time detecting signal and inputs it into a date-update timing control circuit 304. This 0:00-time detecting signal indicates the time of "0:00" (24:00, or 12:00 am) in response to the switch off or open position between the switching shaft 82 and the switching pin 81. Further, a 24-hours counter 306 repeats timekeeping of "24 hours" (resetting every 24 hours) by counting up the 1 Hz clock signal supplied from the divider circuit 204. When the date-update timing control circuit 304 receives a reset signal from the above-mentioned reset detecting circuit 208, it outputs the signal to the 24-hours counter. When the 24-hours counter 306 receives the reset signal, the counting value is reset.

When the date updating timing control circuit 304 receives the power-saving mode transfer signal PS from the power-saving control circuit 400, it detects transfer of an operation mode from the display mode to the power-saving mode.

Also, when the date-updating timing control circuit 304 receives any one of the signal for normal drive NORM of the date dial, the signal for decelerating drive DECL of the date dial, and the signal for prohibiting drive PROH of the date dial, it detects transfer of an operation mode from the display mode to the power-saving mode.

The date updating timing control circuit 304 implements the following two kinds of operations in response to the detected operation mode. Namely, in the display mode, when the date updating timing control circuit 304 receives the 0:00-time detecting signal from the input circuit 302, it resets the 24 hours counter 306 and transmits a 24-hours elapsed signal to the date-dial drive portion G and the day counter 308. On the other hand, in the power-saving mode, the date updating timing control circuit 304 outputs the 24-hours elapsed signal only to the day counter 308 when a carry occurs in the 24-hours counter 306 (when "one day" elapses).

The day counter 308 counts from value "1" to "31" repeatedly, and indicates "a day" by the counted value. Whenever the day counter 308 receives the 24-hours elapsed signal from the date updating timing control circuit 304, it increments the count value by "1" and outputs a day counter signal to a month counter 310 when a carry occurs (namely, when 31 days has elapsed). The month counter 310 counts form value "0" to "11" repeatedly, and indicates "a month" by the counted value. Whenever the month counter 310 receives the day counter signal, it increments the count value by "1" and outputs a month counter signal to the year counter 312 (namely, when 12 months has elapsed). Whenever the year counter 312 receives the month counter signal, it increments the counted value by "1" to show a Christian era year. Hence, current "year", "month" and "day" are displayed by "year" indicated by the year counter 312, "month" indicated by the month counter 308 and "day" indicated by the day counter 308.

A non-existent day detecting circuit 314 determines whether "year", "month" and "day" corresponding to the "year" indicated by the year counter 312, "month" indicated by the month counter 308 and "day" indicated by the day counter 30" exist in a calendar or not. It outputs a non-existent day detecting signal to the date-dial drive portion G if this is a non-existent day (e.g. Apr. 31, 2003). Further, this non-existent day detecting circuit 314 may or may not be structured for a leap year. When the day counter 308 receives the non-existent day detecting signal, it increments the counted value by "1". Further when the date-dial drive portion G receives either of the 24-hours elapsed signal from the date-updating timing control circuit 304 or the non-existent day detecting signal from the non-existent day detecting circuit 314, it applies voltage to a piezo actuator 71 to drive the date dial 75. Whenever the date-dial drive portion G applies voltage to the piezo actuator 71 to drive the date dial 75 one day, it outputs a day displaying-location change signal to a day displaying-location counter 316.

The day displaying-location counter 316 repeats counting from "0" to "30" and stores the value decreased by "1" from the "day", which is displayed in the initial state of the electronic timepiece 100, as the initial value. Whenever the day displaying-location counter 316 receives a day displaying-location change signal from the date dial drive portion G, it increments a counted value by "1". Hence, a counted value in the day displaying-location counter 316 always coincides with the value decreased by "1" from the "day", displayed by the date dial 75. Further, the day displaying location counter 316 outputs a counted value to the power-saving control circuit 400 as a day displaying location signal. The day counter 308 outputs a counted value to the power-saving control circuit 400 as a day counter signal. The power-saving control circuit 400 detects the total numbers of days that must be driven forward at the time of transfer from the power-saving mode to the displaying mode by calculating the difference between a counted value indicated by the day displaying-location signal and a counted value indicated by the day counter signal.

Further, when the date updating timing control circuit 304 receives various control signals outputted from the power-saving control circuit 400 at the time of transfer from the power-saving mode to the displaying mode, it drives the date dial 75 via the date-dial drive portion G in response to these control signals. In detail, when the date updating timing control circuit 304 receives a date dial normal drive signal NORM, it applies voltage at a driving frequency 128 Hz to the actuator 71 so that the date dial 75 is driven. When it receives the signal for decelerating the date dial DECL, it applies voltage at a driving frequency 16 Hz to the actuator 71 so that the date dial 75 is driven. Further, when the date updating timing control circuit 304 receives the signal for prohibiting drive of the date dial PROH, it prohibits drive of the date dial 75.

Figure 4:
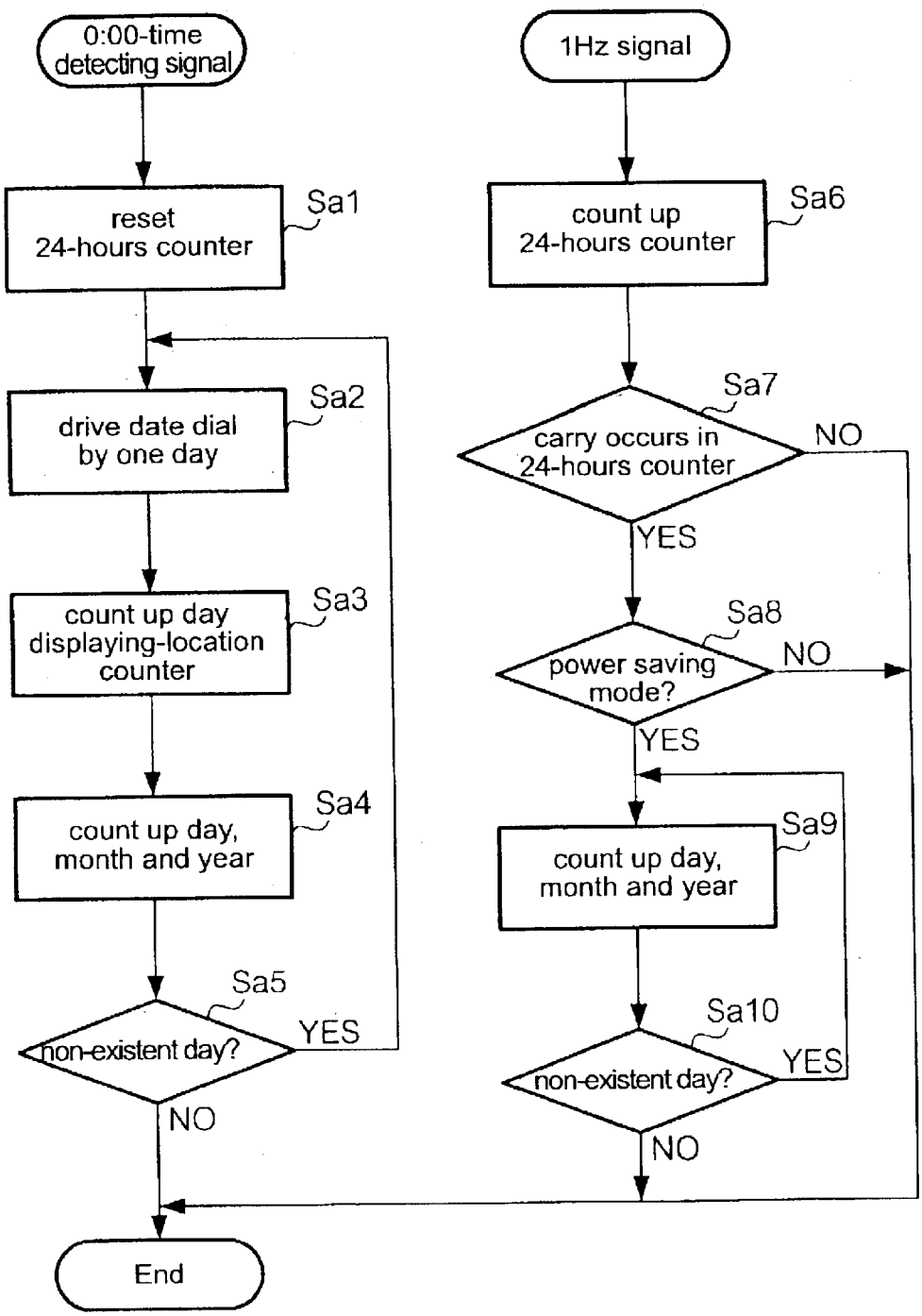
FIG. 4 is a flow chart of a date updating process implemented by the control section.

Next, processing of date updating by the control portion C will be explained with reference to FIG. 4. Note that the date-updating control circuit 300 forms part of the control portion C as shown in FIG. 2. This process of date updating is to update the date display along with a calendar during the display mode and to update "year" "month" and "day" composed of "year" indicated by the year counter 312, "month" indicated by the month counter 310 and "day" indicated by the day counter 308 along with a calendar. As shown in FIG. 4, in this processing of date updating, triggering by the 0:00-time detecting signal input to the input circuit 302, included in the controller C, is implemented in parallel with triggering by 1 Hz signal input to the 24 hours counter 306, included in the controller C.

Firstly, triggering by the 0:00-time detecting signal in the controller C will be explained. At first, when the 0:00-time detecting signal is received, the 24-hours counter 306 resets the counted value in step Sa1. Next, the controller C drives the date dial 75 by one day via the date-dial drive portion G at step Sa2. Subsequently, the date displaying-location counter 316, included in the controller C, increments a counted value by "1" in a step Sa3. Hence, the date indicated by a counted value of the day displaying-location counter 316 coincides with the date displayed by the date dial 75.

Next, in a step Sa4, the day counter 308, included in the controller C, increments the counted value by "1". The month counter 310 increments a counted value by "1" when a carry occurs in the day counter 308. The year counter 312 increments the counted value by "1" when a carry occurs in the month counter 310." Hence, whenever the "31st" day is counted by the day counter 308" (i.e. the counter counts up 1 from "31" and resets to "1", "month" indicated by a counted value of the month counter 310 is updated. Whenever "12" is counted (carry occurs resetting to "1") by the month counter 310, "year" indicated by a counted value of the year counter 312 is updated.

Subsequently, in a step Sa5, the non-existent day detecting circuit 314 included in the control portion C determines whether "day", "month" and "year"; consisting of "year" indicated by the year counter 312, "month" indicated by the month counter 310 and "day" indicated by the day counter 308, represent a non-existent day in a calendar or not. If this judgment is "Yes", namely the day represented is a non-existent day in the calendar, the controller C returns the routine to step Sa2 and repeats the processing from the step Sa2 to the step Sa5 until the "day", "month" and "year" consisting of "year" indicated by the year counter 312, "month" indicated by the month counter 310 and "day" indicated by the day counter 308, exists as a day in a calendar. On the other hand, if the judgment in step Sa5 is "No", the control portion C completes (End) the processing where the 0:00-time detecting signal is used as a trigger. Hence, according to the processing from the step Sa2 to the step Sa5, the control portion C can update the date displayed by the date dial 75 along with a calendar since non-existent days such as "29th" day, "30th" day and "31st" day in February, for example, are skipped.

Next, with reference to FIG. 4, an explanation of how the control portion C implements the process with the 1 Hz signal as a trigger is provided.

At first when the 24-hours counter 306, included in the control portion C, receives the 1 Hz signal, it increments a counted value by "1 second" (i.e. for each second measured by each reception of the 1 Hz signal, e.g. a low-to-high transition on the signal line) in step Sa6. Next, the control portion C determines whether carry occurred in the 24-hours counter 306 in step Sa7. If this judgment is "No", the controller C completes the process where the 1 Hz signal is used as trigger, with the 24-hours counter continuing to count up in response to the continuing receipt of the 1 Hz signal.

On the other hand, if the judgment in the step Sa7 is "Yes", the control portion C determines in a step Sa8 whether the mode of operation is the power-saving mode or not. If this judgment is "No", the control portion C completes the processing with the 1 Hz signal as a trigger. On the other hand, if the judgment in a step Sa8 is "Yes", the day counter 308, included in the control portion C, increments a counted value by "1" in a step Sa9. The month counter 310 increments a counted value by "1" when a carry occurs in the day counter 308. The year counter 312 increments the counted value by "1" when a carry is occurs in the month counter 310."

Next, the non-existent day detecting circuit 314, included in the control portion C, determines whether "day", "month" and "year"; comprised of "year indicated by the year counter 312, "month" indicated by the month counter 310 and "day" indicated by the day counter 308, represent a non-existent day in a calendar or not, in step Sa10. If this judgment is "Yes", namely a non-existent day is indicated, the controller C returns the routine to step Sa9 and repeats processing from the step Sa9 to the step Sa10 until the "day", "month" and "year"; comprised of "year" indicated by the year counter 312, "month" indicated by the month counter 310 and "day" indicated by the day counter 308, exists as a day in a calendar. Hence, "year", "month" and "day" specified by a counted value of each of the year counter 312, the month counter 310 and the day counter 308 are updated with reference to a calendar even in the power saving mode. On the other hand, if the judgment in the step Sa10 is "No", the control portion C completes the processing with the 1 Hz signal as a trigger.

Figure 5:
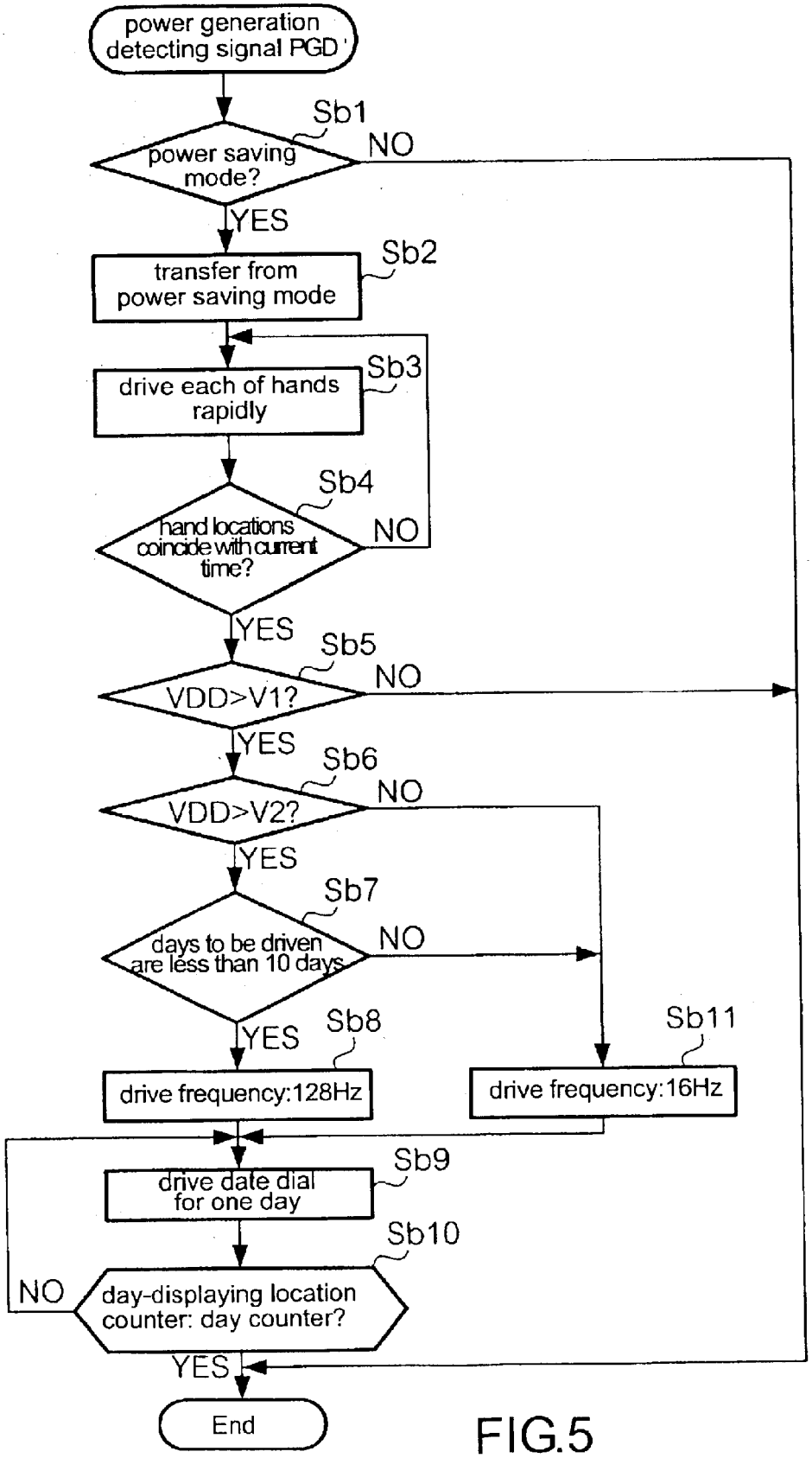
FIG. 5 is a flow chart of the transition to the display mode implemented by the control section.

Next, the processing of the transfer to the display mode by the control portion C will be explained with reference to FIG. 5. This processing of transfer to the display mode includes processing of transfer from the power-saving mode to the display mode and processing of updating the date displayed, which was stopped at the start of the power-saving mode, to a current date at the time of transfer from the power-saving mode to the display mode. Further, processing of transfer to the display mode begins with the power-generation detecting signal PGD as a trigger.

At first, when the control portion C receives the power-generation detecting signal PGD, it determines whether the mode of operation is the power-saving mode or not in a step Sb1. If this judgment is "No", namely the timepiece is in the display mode, processing of transfer to the display mode is completed (End). On the other hand, if the judgment of a step Sb1 is "Yes", the control portion C switches the timepiece out of the power-saving mode in a step Sb2.

Next, the control portion C drives each of the second hand 61, the minute hand 62 and the hour hand 63 forward rapidly by a predetermined amount (for example, 1 time scale in the time indicator panel 103) in a step Sb3. Next, the control portion C determines whether the displayed time displayed by each of hands, driven rapidly, coincides with the current time that is represented by a counted value in a counter included in the power-saving control circuit 400, in a step Sb4. Details of the power-saving control circuit are described hereinafter with reference to FIG. 6. If this judgment is "No", the control portion C returns the routine back to step Sb3. Each of hands, stopped at the transfer to the power-saving mode is driven forward rapidly in these steps Sb3 and Sb4 until the hands coincide with the current time. Then, each of hands is driven forward with normal speed to indicate normal time thereafter.

Once the judgment of step Sb4 is "Yes", the control portion C controls drive of the date dial 75, which was stopped at transfer to the power-saving mode, in order to display the current date. At first, the control portion C determines whether the source voltage VDD of the power supply unit B is higher than the low threshold voltage V1 in a step Sb5. If this judgment is "No", the control portion C completes processing of transfer to the display mode. In other words, the date dial 75 is not driven under this circumstance. This corresponds to the date updating timing control circuit 304 receiving the signal for prohibiting drive of the date dial PROH to prohibit drive of the date dial 75

On the other hand, if the judgment in the step Sb5 is "Yes", the control portion C determines whether the source voltage VDD is higher than the high threshold voltage V2 in a step Sb6.

If the judgment in the step Sb6 is "No", namely when the source voltage VDD is less than or equal to the threshold voltage V2, the control portion C sets the frequency of the driving signal, of which voltage is applied to the actuator 71, to 16 Hz in the step Sb11. This corresponds to the date updating timing control circuit 304 receiving a control signal DECL to drive the date dial at a speed slower than the normal update speed (the normal update speed having a drive frequency of 128 Hz). The control portion C drives the date dial 75 with voltage of the driving signal frequency 16 Hz to display a current date in the step Sb9 and the step Sb10.

If the judgment in the step Sb6 is "Yes", the control portion C determines in a step Sb7 whether the days to be driven forward by the date dial 75, indicated by the difference between a counted value of the day-displaying location counter 316 and a counted value of the day counter 308, are less than 10 days or not. Alternatively, although not shown in FIG. 5 for clarity, the process can proceed directly to step Sb8. In this alternative of the present invention, the number of days to be driven is not considered and the normal update speed is selected as long as the source voltage VDD is greater than the high threshold voltage V2.

Referring again to FIG. 5, if the judgment in a step Sb7 is "No", namely if the days to be driven forward by the date dial 75 is greater than or equal to ten days, the control portion C sets the frequency of the driving signal, of which voltage is applied to the actuator 71, to 16 Hz in a step Sb11. This again corresponds to the date updating timing control circuit 304 receiving a control signal DECL to drive the date dial at a speed slower than the normal update speed (the normal update speed having a drive frequency of 128 Hz). The control portion C drives the date dial 75 with voltage of the driving signal frequency; 16 Hz in the step Sb9 and the step Sb10 to display a current date.

If the judgment in Sb7 is "Yes", the control portion C sets the driving signal frequency, of which voltage is applied to the actuator 71, to 128 Hz in a step Sb8. This corresponds to the date updating timing control circuit 304 receiving a control signal NORM to drive the date dial at the normal update speed. The control portion C drives the date dial 75 by one day via voltage of the driving signal of the frequency 128 Hz in a step Sb9.

Subsequently the control portion C determines whether a counted value of day displaying-location counter 316, representing a displayed date, coincides with a counted value of the day counter 308, representing a current date, or not in a step Sb10. If this judgment is "Yes", the control portion C completes this processing. On the other hand, if the judgment in the step Sb10 is "No", the control portion C returns the routine back to the step Sb9. Further, the control portion C drives the date dial 75 by the voltage of the driving signal of the frequency 128 Hz in the process of the step Sb9 and the step Sb10 to display a current date.

Thus, if the source voltage VDD is lower than or equal to the low threshold voltage VI, the date dial 75 is not driven at the time of transfer from the power-saving mode to the display mode. Hence, when the source voltage VDD is very low, there is no chance that the timepiece will have a loss of functionality and possibility display the wrong time due to power loss from driving of the date dial 75 since the date dial 75 is not driven. When the date dial 75 is not driven, a user updates the date manually by operation of the crown 104.

Further, when the source voltage VDD is greater than the low threshold voltage V1 but less than or equal to the threshold voltage V2, or the number of days to be driven forward by the date dial 75 is more than or equal to 10 days, the date dial 75 is driven by the voltage with a driving signal frequency of 16 Hz, in which the energy consumption per unit hour is smaller than that of the voltage of the driving signal frequency 128 Hz. Hence, a sudden voltage drop of the power supply unit B is prevented and system failure due to drive of the date dial 75 can be avoided thereby. Further, when the source voltage VDD is higher than the threshold voltage V2 and the number of days to be driven forward by the date dial 75 is less than 10 days, there is no possibility of system failure due to voltage drop caused by drive of the date dial 75. Hence, the date dial 75 is driven by the voltage with a driving signal frequency 128 Hz. Alternately, if the high threshold voltage is set high enough, the number of days to be driven does not have to be considered and the dial is driven with the high frequency (high speed) as long as the source voltage is above the high threshold. Thus, the date display is updated rapidly when there is a transfer from the power-saving mode to the display mode. Further, in the present embodiment, the frequency of the driving signal (and thus the drive speed) set in the step Sb8 and in the step Sb11, is each of 128 Hz and 16 Hz. But this is just an example, and the present invention is not limited to these values. Other values may be selected that are suitable to a particular timepiece.

A second embodiment is described as follows.

In the above-mentioned first embodiment, it was explained that in the electronic timepiece 100 the drive of each of the handles and drive of the date dial 75 are stopped simultaneously at the time of transferring to the power-saving mode and the date dial 75 is controlled to be driven on the basis of the source voltage VDD of the power supply unit B and/or the number of days to be driven forward at the time of transfer from the power-saving mode to the display mode. On the other hand, in the second embodiment, it will be explained that in the electronic timepiece 100 drive of each hand is stopped in the power-saving mode, but the date dial 75 continues to be driven in the power-saving mode.

There are differences between the first embodiment of the electronic timepiece 100 and the second embodiment in electronic timepiece 100, with respect to the structures of the power-saving control circuit 400 and the date updating circuit 300 included in control portion C. Further, the control portion C in the second embodiment is not provided with the voltage detection circuit 212 included in the control portion C in the first embodiment. Further, the electronic timepiece 100 in the second embodiment is provided with an outside operation member in order to cause transfer to the power-saving mode during the display mode. Hence, a user can force transfer of the timepiece to the power-saving mode so that the timepiece will enter the power-savings mode even if the "non-used time" has not reached a predetermined time.

Figure 6:
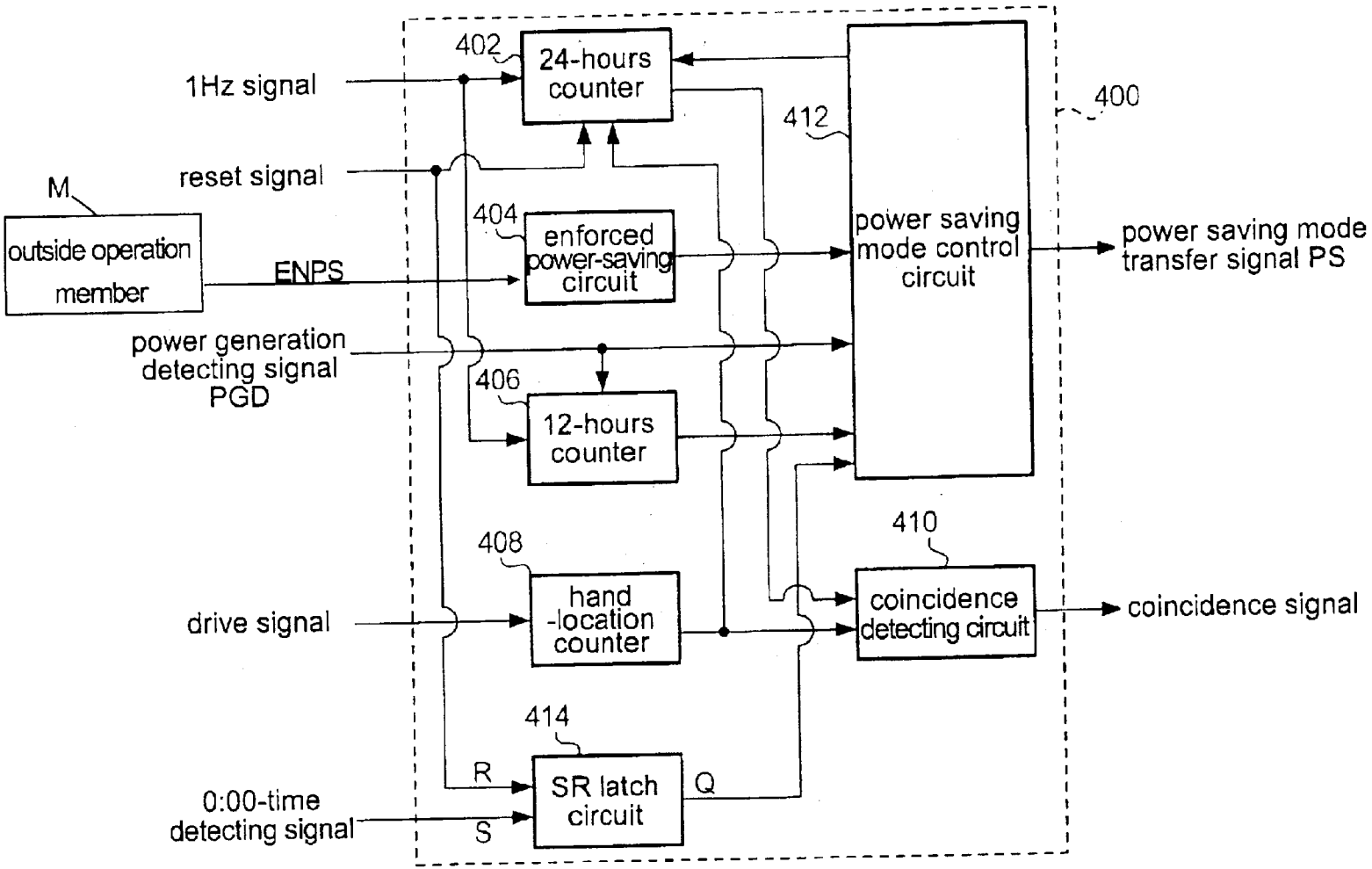
FIG. 6 is a functional block diagram of a power-saving control circuit of an electronic timepiece according to the second embodiment of the present invention.

FIG. 6 shows a functional block diagram of the power-saving control circuit 400 in the second embodiment. In this circuit, the 12-hours counter 406 repeats timekeeping of "12 hours" by counting up with the 1 Hz signal that is input from the dividing circuit 204. The counted value is reset whenever the power-generation detecting signal PGD is received. The 12-hours counter 406 measures the term when the power-generation detecting signal PGD is not received, namely, the elapsed time of non-power generation in the display mode, and outputs the 12-hours elapsed signal to the power-saving mode control circuit 412 when a carry occurs. The electronic timepiece 100 in the second embodiment is transferred from the display mode to the power-saving mode when a carry occurs in the 12-hours counter 406 in the display mode, namely when non-power generation time reaches "12 hours".

Here, in the second embodiment, whether the electronic timepiece 100 is used or not is determined by whether non-power generation time reaches "12 hours" or not. But, non-power generation time used for this determination is not limited to "12 hours" and other suitable elapsed time period can be selected for a particular timepiece.

Further, even if non-power generation time does not reach "12 hours", the electronic timepiece 100 can be transferred from the display mode to the power-saving mode by a user's operation of an outside operation member M. When an enforced power-saving circuit 404 receives an enforced power save signal ENPS indicating transfer from the displaying mode to the power-saving mode from the outside operation member, it outputs an enforced power-saving signal to a power-saving mode control circuit 412.

When the power-saving mode control circuit 412 receives either the 12-hours elapsed signal from the 12-hours counter 406 or the enforced power-saving signal from the enforced power-saving circuit 404, it outputs a power-saving mode transfer signal PS to the second hand drive portion E1, the hour and minute hands drive portion E2 and the 24-hours counters. This signal PS controls transfer from the display mode to the power-saving mode. The second hand drive portion E1, and the hour and minute hands drive portion E2 stop drive of each respective hand when they receive the power-saving mode transfer signal PS. Further, in the first embodiment, the power-saving mode transfer signal PS, output by the power-saving control portion 400, is supplied to the date-updating control circuit 300. On the other hand, in the second embodiment, the power-saving mode transfer signal PS is not supplied to the date-updating control circuit 300 in order not to stop drive of the date dial 75 during the power-saving mode.

Further, when the power-saving mode control circuit 412 receives the power-generation detecting signal PGD during the power-saving mode, it releases the power-saving mode and outputs a display mode transfer signal to the 24-hours counter 402 and the divider circuit 204. This display mode transfer signal controls transfer to the display mode. When the divider circuit 204 receives a display-mode transfer signal, it drives each of hands forward via the second hand drive portion E1 and the hours and minute drive portion E2 in order that each of hands, which were stopped in the power-saving mode, displays current time using a counted value of the 24-hours counter 402 described hereafter. Further, in the above-mentioned first embodiment, the power-saving control circuit 400 outputs various control signals such as a date dial deceleration signal at the time of transfer from the power-saving mode to the display mode. On the other hand, in the second embodiment, these signals are not output from the power-saving control circuit 400 in order not to stop drive of the date dial 75.

The hand-location counter 408 represents a location of each of the second hand 61, the minute hand 62 and the hour hand 63 and outputs a hand-location signal that indicates a location of each of hands to the coincidence-detection circuit 410 and the 24-hours counter 402.

The 24-hours counter repeats timekeeping "24 hours" by counting up with the 1 Hz signal during the power-saving mode. When the 24-hours counter 402 receives the power-saving mode transfer signal PS from the power-saving mode control circuit 412, it sets a counted value that represents the current time indicated by the hand-location signal and measures current time during the power-saving mode. Further, when the 24-hours counter 402 receives the display mode transfer signal PS from the power-saving mode control circuit 412, it outputs current time as a 24-hours counter signal to the coincidence detection circuit 410. Further, when the 24-hours counter 402 receives a reset signal from the reset detecting circuit 208, it resets the counted value.

In the case when each of the hands is driven rapidly by the divider circuit 204, i.e. when transferring back to the display mode, the hand-location signal and the 24-hours counter signal are input to the coincidence-detection circuit 410 that determines whether displayed time of each of hands, indicated by the hand-location signal, coincides with the current time, indicated by the 24-hours counter signal, or not. It outputs a coincident signal to the divider circuit 204 when these coincide with each other. When the divider circuit 204 receives the coincidence signal, it stops rapid drive of each of hands via the second hand drive portion E1 and the hour and minute hands drive portion E2 and drives them forward with normal speed.

An SR latch circuit 414 includes a set input (S) for receiving the 0:00-time detecting signal that indicates time of "0:00" (24:00) in response to opening of the switching shaft 82 and the switching pin 81, a reset input (R) for receiving the reset signal that is output from the reset detection circuit 208 and a output (Q) for outputting a signal corresponding to the input signal to the power-saving mode control circuit 412. In detail, when the 0:00-time detecting signal is input to the set input (S) of the SR latch circuit 414, an "H" level signal is output from the output (Q). When the reset signal is input to the reset input (R), an "L" level signal is output from the output (Q).

Hence, if the SR latch is outputting the "L" level, it means that the 0:00-time detecting signal has not been received after the reset signal has been input to the latch. In other words, this indicates that the 0:00-time detecting signal has yet to be generated in the electronic timepiece 100 after the system is reset. So, the time on the timepiece was changed by hand and reset by operation of the crown but after that change the hour wheel has not rotated to the 24:00 position. The power-saving mode control circuit 412 prohibits transfer from the display mode to the power-saving mode while "L" level signal is input from the SR latch 414. So, the power-savings mode cannot be entered after a reset until the first 0:00-time detecting signal is received.

Next, the date-updating control circuit 300 in the second embodiment will be explained. In the above-mentioned first embodiment, the 24-hours counter 306, included in the date-updating control circuit 300, resets a counted value whenever the 0:00 time detection signal is inputted. On the other hand, the 24-hours counter 402 in the second embodiment resets the counted value only when the first 0:00-time detection signal among the 0:00-time detection signals is input to the power-savings control circuit 400 after the reset signal, which is output from the reset detection circuit 208, is input to the power-savings control circuit 400. Further, the date-updating control circuit 300 in the first embodiment updates a date in the display mode, whenever the 0:00-time detection signal is inputted. On the other hand, the date-updating control circuit 300 in the second embodiment updates the date when the first 0:00-time detection signal is input after the reset signal that is output from the reset detection circuit 208 is input and thereafter updates the date, regardless of the mode of operation, whenever the 24-hours elapsed signal is output from the 24-hours counter 306. This is because in the second embodiment, the date continues to be changed (updated) even in the power-saving mode, rather than advancing it quickly to bring it up to the current date when transferring back to the display mode.

Figure 7:
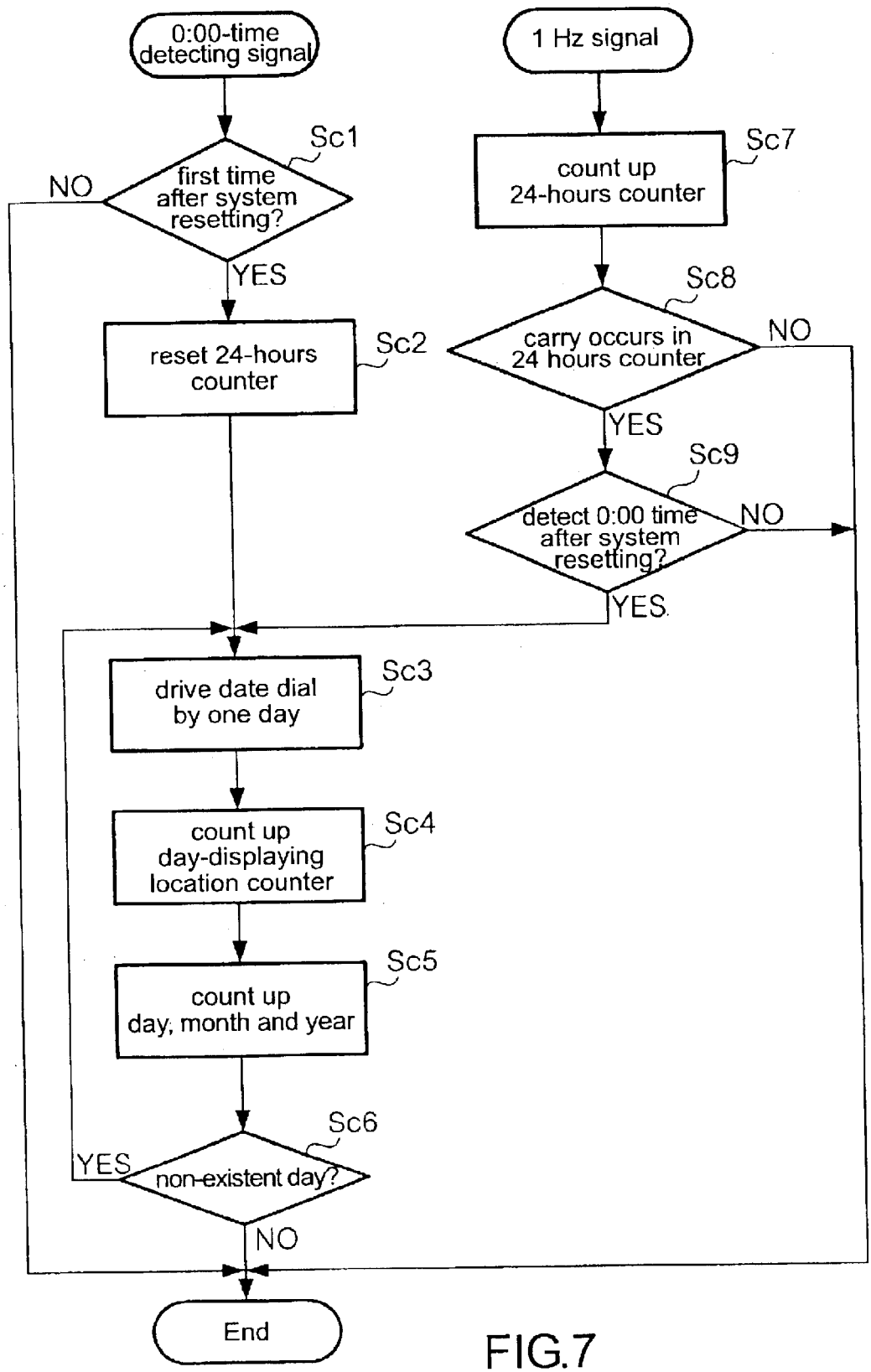
FIG. 7 is a flow chart of a date updating process implemented by the control section of the electronic timepiece according to the second embodiment of the present invention.

Next, a date updating process by the control portion C will be explained with reference to FIG. 7. In the date updating process of the above-mentioned first embodiment, the date display is updated, with reference to a calendar (to correct for non-existent days), only when the operational mode is the display mode. On the other hand, in date updating process of the second embodiment, the date display is updated, with reference to a calendar, in both the display mode and the power-saving mode. In this date updating process, the control portion C implements both the process in both modes with the 0:00-time detecting signal as a trigger and process with the 1 Hz signal as a trigger in parallel.

Firstly, in date updating process, the process performed by the control portion C with the 0:00-time detecting signal as a trigger will be explained with reference to FIG. 7.

At first, when the date-updating timing control circuit 304, included in the control portion C, receives the 0:00-time detecting signal, it determines whether this is the first 0:00-time detecting signal that received after the reset signal, output from the reset detecting circuit 208, is received. In other words, the date-updating timing control circuit 304 determines whether the 0:00-time detecting signal is input for the first time or not after system is reset. If the judgment is "No" (i.e. second, third, fourth, etc. time), the control portion C completes the process that uses the 0:00-time detecting signal as a trigger.

On the other hand, if the judgment in a step Sc1 is "Yes", the 24-hours counter 306, included in the control portion C, resets the counted value in a step Sc2. Next, the control portion C drives the date dial 75 by one day via the date-dial drive portion G in a step Sc3. Subsequently, the day display-location counter 316, included in the control portion C, increments a counted value by "1" in a step Sc4. Hence, a date indicated by counted value of the day display-location counter 316 coincides with a date displayed by the date dial 75.

Next, the day counter 308, included in the control portion C, increments a counted value by "1" in a step Sc5. The month counter 310 increments a counted value by "1", when a carry occurs in the day counter 308. The year counter 312 increments a counted value by "1", when a carry occurs in the month counter 310." Subsequently the non-existent day detecting circuit 314, included in the control portion C, determines, in step Sc6, whether "year" and "month" and "day"; comprising "year" indicated by the year counter 312, "month" indicated by the month counter 310 and "day" indicated by the day counter 308, are non-existent days in a calendar or not. If this judgment is "Yes", namely non-existent day, the control portion C returns the routine back to the step Sc3. Then, the date display is updated with reference to the calendar by the process from step Sc3 to step Sc6.

On the other hand, if the judgment in the step Sc6 is "No", namely, if "year" and "month" and-"day"; comprised of "year" indicated by the year counter 312, "month" indicated by the month counter 310 and "day" indicated by the day counter 308, represent an existent day on a calendar, the control portion C completes process that uses the 0:00-time detecting signal as a trigger.

Next, the process of date updating by the control portion C with the 1 Hz signal used as a trigger will be explained.

At first, when the 1 Hz signal is received, the 24-hours counter 306, included in the control portion C increments the counted value by "1" (for each second measured by each reception of the 1 Hz signal, e.g. a low-to-high transition on the signal line) in a step Sc7. Next, the control portion C determines whether a carry occurs in the 24-hours counter 306 or not in a step Sc8. If this judgment is "No", the control portion C completes process using the 1 Hz signal as a trigger. Of course, this process is repeated as each 1 Hz signal is received (i.e. every second)

On the other hand, if the judgment in the step Sc8 is "Yes", the control portion C determines whether the 0:00-time detecting signal has been received, or not, after system-resetting in a step Sc9. If this judgment is "No", the control portion C completes process using the 1 Hz signal as a trigger.

On the other hand, if the judgment in the step Sc9 is "Yes", the control portion C transfers the routine to the above-mentioned step Sc3. Then, the control portion C updates the date display with reference to a calendar in the process from the step Sc3 to the step Sc6. Thus, in the date updating process of the second embodiment, the displayed date is updated regardless of mode of operation. In detail, the date is updated when the control portion C receives the first 0:00-time detecting signal after system resetting in the display mode (the process of the step Sc3 with the 0:00-time detecting signal as a trigger). Thereafter, it updates the date whenever the 24-hours elapsed signal is output from the 24-hours counter 306 regardless of the mode of operation (the process of the step Sc3 with the 1 Hz signal as a trigger). Thus, in the electronic timepiece of the second embodiment, a date displayed by the date dial 75 is updated even in the power saving mode. Hence, the date dial 75 is not driven continuously to bring it up to the current date at the time of transfer from the power-saving mode to the display mode. Therefore, in the electronic timepiece 100 of the second embodiment, there is no possibility of a system failure due to the rapid drive of the date dial 75, and associated surge in power consumption, at the time of transfer from the power-saving mode to the display mode.

Figure 8:
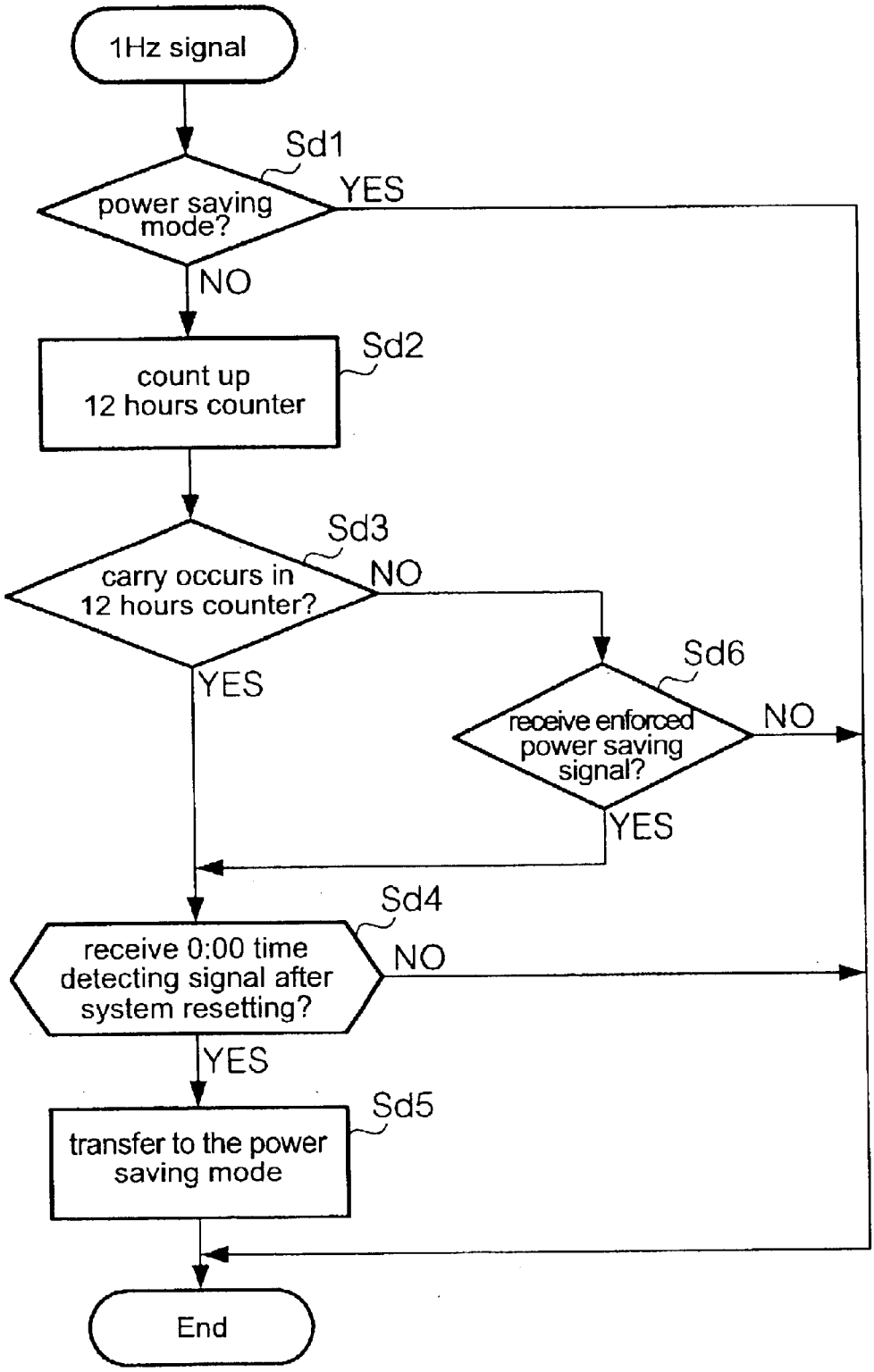
FIG. 8 is a flow chart of the process of transition to the power-saving mode implemented by the control section.

Next, the process of transfer to the power-saving mode by the control portion C will be explained with reference to FIG. 8. This process of transfer to the power-saving mode is a process of transfer from the display mode to the power-saving mode and the control portion C implements the process using the 1 Hz signal as a trigger. In the second embodiment, the control portion C prohibits transfer to the power-saving mode until the first 0:00-time detecting signal is received after system-resetting, even if non-power generation time during the display mode has exceeded the predetermined time period (12 hours in the second embodiment).

At first, the control portion C determines whether the operational mode is the power-saving mode or not in a step Sd1 when it detects the lHz signal.

If this judgment is "Yes", the control portion C completes the process. On the other hand, if the judgment in a step Sd1 is "No", the 12-hours counter 406, included in the control portion C, increments the counted value by "1" (for each second measured by each reception of the 1 Hz signal, e.g. a low-to-high transition on the signal line) in a step Sd2. Here, the 12-hours counter 406 is always reset in the display mode when the power-generation detecting signal is input so that the 12-hours counter 406 measures the non-power generation time.

Next, the control portion C determines in a step Sd3 whether a carry occurred in the 12-hours counter 406 or not. In other words, the control portion C determines whether the non-power generation time reaches 12 hours or not. If this judgment is "Yes", the control portion C transfers the routine to step Sd4 described below.

On the other hand, if the judgment of the step Sd3 is "No", the power-saving mode control circuit 412, included in the control portion C, determines whether the enforced power-saving signal is received or not in a step Sd6. In other words, it determines by operation of the outside operation member whether transfer to the power-saving mode is commanded by a user or not. If this judgment is "No", the control portion C completes the process (End). On the other hand, if the judgment of the step Sd6 is "Yes", the control portion C transfers the routine to the step Sd4.

Next, the power-saving-mode control circuit 412, included in the control portion C, determines whether the 0:00-time detecting signal is received, or not, after system-resetting in the step Sd4. In this judgment, the power-saving-mode control circuit 412 determines whether the signal, input from the SR latch circuit 414, has transitioned from "L" level to "H" level or not. If this judgment is "Yes", the control portion C transfers operational mode from the display mode to the power-saving mode in a step Sd5.

On the other hand, if the judgment of the step Sd4 is "No", the control portion C completes the process and ends. But of course it repeats with the reception of the next 1 Hz signal. The control portion C prohibits transfer from the display mode to the power-saving mode until the first 0:00-time detecting signal is received after system-resetting by the judgment made in step Sd4 The reason for taking account of such step in the transfer to the power-saving-mode is the following: In order to update the date even in the power-saving mode, the electronic timepiece 100 in the second embodiment updates a date when the first 0:00-time detecting signal is received after system-resetting. Thereafter, it updates a date whenever the 24-hours signal is output from the 24-hours counter 306. Hence, the output timing of the 24-hours elapsed signal must coincide with output timing of the 0:00-time detecting signal. However, when the system is reset in the electronic timepiece 100, a counted value of the 24-hours counter 306 is reset regardless of whether the displayed time of each hand is 0:00 or not. Hence, when system is reset, namely, when the reset signal is output from the reset detection circuit 208, the output timing of the 24-hours elapsed signal does not always coincide with the output timing of the 0:00-time detecting signal. Hence, in the second embodiment, transfer from the display mode to the power-saving mode is prohibited until the 24-hours counter 306 is reset with the 0:00-time detecting signal as a trigger, after system-resetting. Thus, transfer from the display mode to the power-saving mode is permitted thereby, after the timing of driving a date forward with the 24-hours elapsed signal is made to coincide with the timing of driving a date forward with the 0:00-time detecting signal. Therefore, the timing of driving a date forward with the 24-hours elapsed signal is accurate.

An alternative to the second embodiment is described as follows.

In the above-mentioned process for transfer to the power-saving mode of the second embodiment, transfer from display mode to the power-saving mode is prohibited until the first 0:00-time detecting signal is received after system-resetting. But such process is not limited to this feature. For example, transfer to the power-saving mode may be prohibited until 24 hours has elapsed after system resetting. There is a difference between the electronic timepiece 100 in this alternative and the electronic timepiece 100 in the above-mentioned second embodiment with respect to the power-saving control circuit 400.

Figure 9:
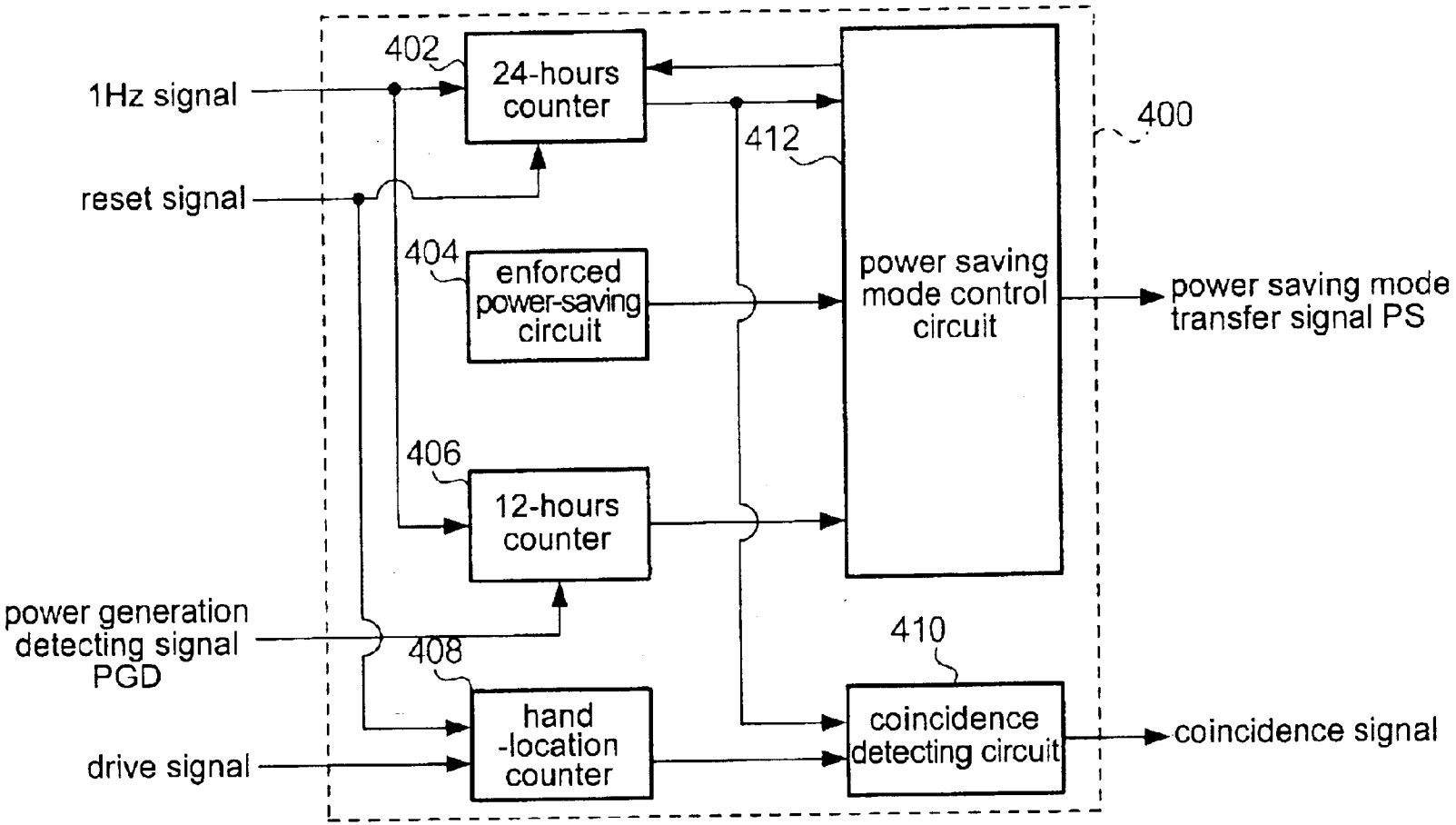
FIG. 9 is a functional block diagram of the power-saving control circuit of an electronic timepiece in an alternative of the second embodiment.

FIG. 9 shows a functional block diagram of the power-saving control circuit 400 in this alternative. In this diagram, the 24-hours counter 402 outputs a reset 24-hours elapsed signal to the power mode control circuit 412. This signal is generated 24 hours after the reset signal is received from the reset detecting circuit 208. This function is performed in addition to the operation of the 24-hours counter 402 described above in the second embodiment, recalling that the 24-hours counter is reset by the reset signal. As described previously with reference to FIG. 6, the power-saving mode control circuit 412 in the second embodiment prohibits transfer from the display mode to the power-saving mode in response to the "L" signal input from the SR latch circuit 414. On the other hand, the power-saving mode control circuit 412 of this FIG. 9 alternative prohibits transfer from the display mode to the power-saving mode until the reset 24 hours elapsed signal is input to power-saving mode control circuit 412. Further the power-saving control circuit 400 in this FIG. 9 alternative is not provided with the SR latch circuit 414, which is included in the, power-saving control circuit 400 of the FIG. 6 second embodiment.

Figure 10:
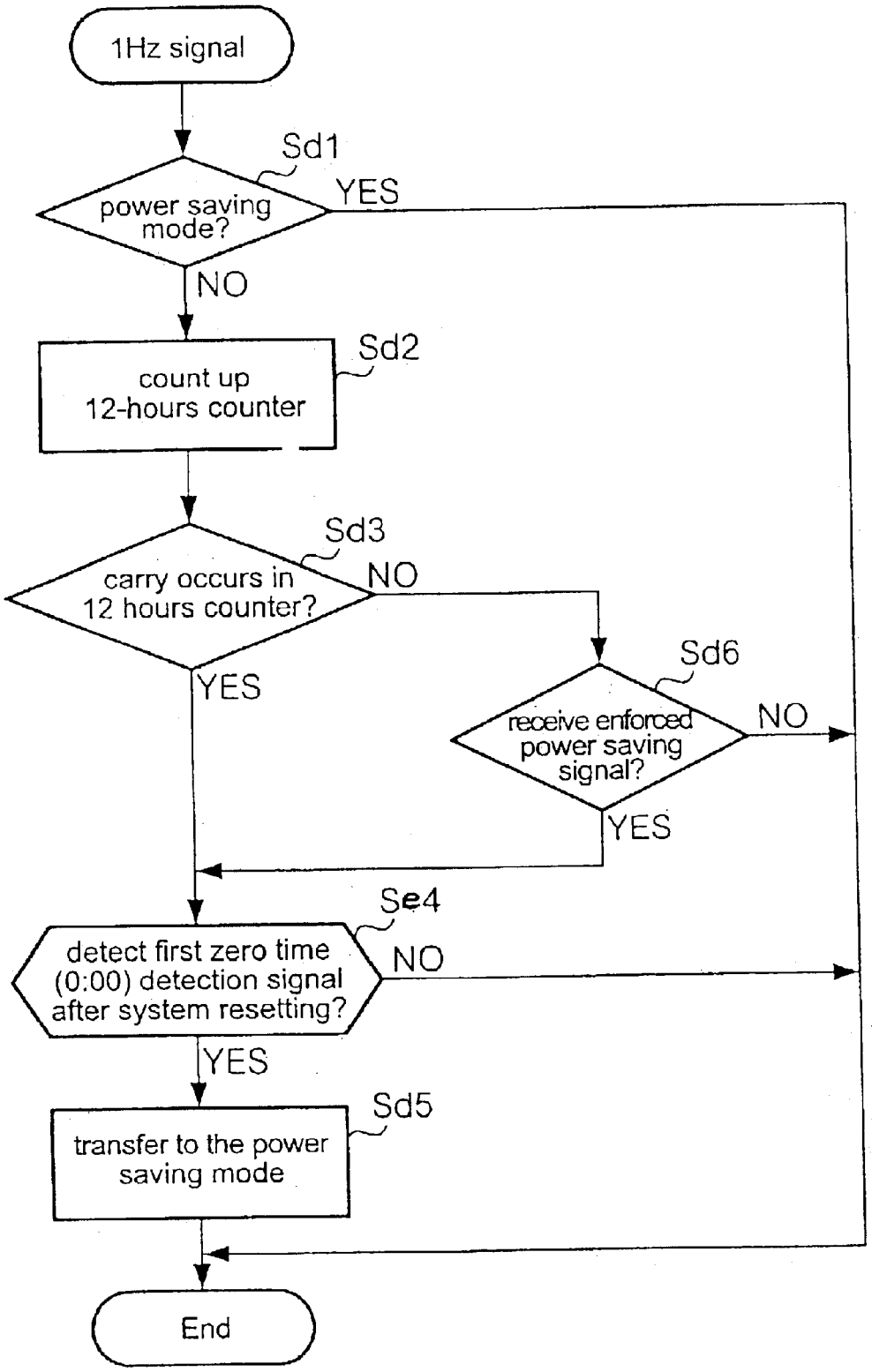
FIG. 10 is a flow chart of the process of transition to the power-saving mode implemented by the control section of the electronic timepiece in the alternative of the second embodiment.

Next, processing of transfer to the power-saving mode in this alternative will be explained with reference to FIG. 10. In FIG. 10, steps that are the same as in the process of transfer to the power-saving mode of the second embodiment have the same step references as in FIG. 8. The process of transfer to the power-saving mode in this alternative (FIG. 10) differs from the process of transfer to the power-saving mode in the second embodiment (FIG. 8) with respect to the determination made in step Se4. This determination is made instead of the step Sd4 in FIG. 8. In step Se4, the power-saving mode control circuit 412, included in the power-saving control portion 400, prohibits transfer to the power-saving mode until it receives the reset 24-hours signal. Hence, by waiting until the reset 24-hours signal is received, transfer from the display mode to the power-saving mode surely does not occur until after the 0:00-time detecting signal is received after system-resetting. Therefore, timing of driving a date forward with the 24-hours elapsed signal as a trigger in this alternative is as accurate as in the FIG. 8 second embodiment.

A third embodiment of the present invention is described as follows.

In the electronic timepiece 100 of the first embodiment and the second embodiment, drive of the second hand 61, the minute hand 62 and the hour hand 63 are stopped at the time of transfer to the power-saving mode. On the other hand, in the electronic timepiece 100 of the third embodiment, the minute hand 62, the hour hand 63 and the date dial 75 are driven during the power-saving mode and only drive of the second hand 61 is stopped. According to this method, power consumption can be saved during the power-saving mode by stopping drive of the second hand 61, which consumes a relatively large amount of power. Further, at the time of transfer from the power-saving mode to the display mode, only the second hand 61, which has been stopped at transfer to the power-saving mode, is driven rapidly to the current time. Hence, there is hardly any voltage drop at the time of transfer from the power-saving mode to the display mode so that system failure of the electronic timepiece 100 can be prevented. Here, during the power-saving mode, it is possible to attain further power-saving by setting the time interval of driving the hour hand 63 and the minute hand 62 to be large (for example, irregular driving such as in five minute intervals in case of the minute hand 62).

The present invention is not limited to the above-mentioned first embodiment, the second embodiment and the third embodiment and various applications, improvements and modifications can be considered as falling within the scope of the present invention.

For example, in the first embodiment and the second embodiment, it was explained that the electronic timepiece 100 is provided with the power generation portion A and the second power source. But these embodiments are not limited to this structure. For example, it may be provided with a first power source instead of the power generation portion A and the second power source. In such case, a structure of the electronic timepiece 100 can be simplified since it is not necessarily provided with the power generation portions A and the second power source. Here, in this case, it is necessary to provide a mechanism for determining whether the electronic timepiece 100 is used by a user or not.

Further, in the first embodiment and the second embodiment, it was explained that the electronic timepiece 100 displays a day as information in addition to time. But it is not limited to this. For example, the electronic timepiece 100 may have a calendar member displaying information such as "year", "month" and "day of the week", instead of the date dial 75 displaying a day of the month, and such calendar member is driven so that displayed calendar information is updated.

As discussed above, the present invention is to provide an electronic timepiece that prevents system failure at the time of transfer from the power-saving mode to the display mode.

What is claimed is:

1. An electronic timepiece comprising:

a power source;

a power-saving unit that suspends supply of power from the power source under a predetermined power-saving condition;

a hand-driving unit that drives hands that indicate second, minute and hour by receiving power from the power source;

a date unit that indicates displayed calendar information comprising at least one of year, month, and day;

a date driving unit that drives the date unit by receiving power from the power source;

a date updating unit that updates current calendar information comprising at least one of year, month, and day, while the power-saving unit suspends the supply of power;

a control unit that, upon termination of suspension of the supply of power by the power-saving unit, controls the date driving unit to drive the date unit so that the displayed calendar information coincides with the current calendar information, the control unit being responsive to at least one predetermined timepiece condition for setting a speed of driving of the date unit.

2. An electronic timepiece corresponding to claim 1 further comprising a voltage detection unit that detects an output voltage of the power source;

and the detected output voltage comprises the at least one predetermined timepiece condition.

3. An electronic timepiece corresponding to claim 2, wherein the control unit is responsive to the detected output voltage being greater than a high threshold voltage (V2) for setting the speed of driving of the date unit to a normal date-update driving speed.

4. An electronic timepiece corresponding to claim 2, wherein the control unit is responsive to the detected output voltage being less than or equal to a low threshold voltage (V1) for setting the speed of driving of the date unit to zero, thereby prohibiting driving of the date unit.

5. An electronic timepiece corresponding to claim 2, wherein the control unit is responsive to the detected output voltage being greater than a high threshold voltage (V2) for setting the speed of driving of the date unit to a normal date-update driving speed, and the control unit is responsive to the detected output voltage being less than or equal to a low threshold voltage (V1) for setting the speed of driving of the date unit to zero, thereby prohibiting driving of the date unit, the low threshold voltage being less than the high threshold voltage.

6. An electronic timepiece corresponding to claim 2, wherein the control unit is responsive to the detected output voltage being greater than a high threshold (V2) voltage for setting the speed of driving of the date unit to a normal date-update driving speed, and the control unit is responsive to the detected output voltage being less than or equal to the high threshold voltage for setting the speed of driving of the date unit to a decelerated date-update driving speed, the decelerated date-update driving speed being slower that the normal date-update driving speed.

7. An electronic timepiece corresponding to claim 2, wherein the control unit, upon termination of suspension of the supply of power by the power-saving unit, determines the difference in number of days between the displayed calendar information and the current calendar information and the determined difference comprises another of the at least one predetermined timepiece conditions.

8. An electronic timepiece corresponding to claim 7, wherein the control unit is responsive to the difference in number of days being less than a threshold number of days for setting the speed of driving of the date unit to a normal date-update driving speed, and the control unit is responsive to the difference in number of days being greater than the threshold number of days for setting the speed of driving of the date unit to a decelerated date-update driving speed, the decelerated date-update driving speed being slower that the normal date-update driving speed.

9. An electronic timepiece corresponding to claim 8 wherein the control unit is responsive to the detected output voltage being greater than a high threshold (V2) voltage and the difference in number of days being less than a threshold number of days for setting the speed of driving of the date unit to the normal date-update driving speed, and the control unit is responsive to the detected output voltage being less than or equal to the high threshold voltage for setting the speed of driving of the date unit to the decelerated date-update driving speed.

10. An electronic timepiece corresponding to claim 1 wherein the control unit, upon termination of suspension of the supply of power by the power-saving unit, determines the difference in number of days between the displayed calendar information and the current calendar information and the determined difference comprises the at least one predetermined timepiece condition.

11. An electronic timepiece corresponding to claim 10, wherein the control unit is responsive to the difference in number of days being less than a threshold number of days for setting the speed of driving of the date unit to a normal date-update driving speed, and the control unit is responsive to the difference in number of days being greater than the threshold number of days for setting the speed of driving of the date unit to a decelerated date-update driving speed, the decelerated date-update driving speed being slower that the normal date-update driving speed.

12. A method of operating an electronic timepiece comprising:

supplying power with a power source;

suspending supply of power from the power source under a predetermined power-saving condition;

driving hands, which indicate second, minute, and hour, with a hand-driving unit by receiving power from the power source;

displaying calendar information with a date unit, the displayed calendar information comprising at least one of year, month, and day;

driving the date unit with a date driving unit by receiving power from the power source;

updating current calendar information with a date updating unit while the power-saving unit suspends the supply of power, the current calendar information comprising at least one of year, month, and day;

upon termination of suspension of the supply of power by the power-saving unit, controlling the date driving unit with a control unit to drive the date unit so that the displayed calendar information coincides with the current calendar information, and, responsive to at least one predetermined timepiece condition, setting a speed of driving of the date unit.

13. A method of operating an electronic timepiece corresponding to claim 12 further comprising detecting an output voltage of the power source; and the detected output voltage comprising the at least one predetermined timepiece condition.

14. A method of operating an electronic timepiece corresponding to claim 13, wherein the control unit is responsive to the detected output voltage being greater than a high threshold voltage (V2) for setting the speed of driving of the date unit to a normal date-update driving speed.

15. A method of operating an electronic timepiece corresponding to claim 13, wherein the control unit is responsive to the detected output voltage being less than or equal to a low threshold voltage (V1) for setting the speed of driving of the date unit to zero, thereby prohibiting driving of the date unit.

16. A method of operating an electronic timepiece corresponding to claim 13, wherein the control unit is responsive to the detected output voltage being greater than a high threshold voltage (V2) for setting the speed of driving of the date unit to a normal date-update driving speed, and the control unit is responsive to the detected output voltage being less than or equal to a low threshold voltage (V1) for setting the speed of driving of the date unit to zero, thereby prohibiting driving of the date unit, the low threshold voltage being less than the high threshold voltage.

17. A method of operating an electronic timepiece corresponding to claim 13, wherein the control unit is responsive to the detected output voltage being greater than a high threshold (V2) voltage for setting the speed of driving of the date unit to a normal date-update driving speed, and the control unit is responsive to the detected output voltage being less than or equal to the high threshold voltage for setting the speed of driving of the date unit to a decelerated date-update driving speed, the decelerated date-update driving speed being slower that the normal date-update driving speed.

18. A method of operating an electronic timepiece corresponding to claim 13, further comprising, upon termination of suspension of the supply of power by the power-saving unit, determining the difference in number of days between the displayed calendar information and the current calendar information and the determined difference comprises another of the at least one predetermined timepiece conditions.

19. A method of operating an electronic timepiece corresponding to claim 18, wherein the control unit is responsive to the difference in number of days being less than a threshold number of days for setting the speed of driving of the date unit to a normal date-update driving speed, and the control unit is responsive to the difference in number of days being greater than the threshold number of days for setting the speed of driving of the date unit to a decelerated date-update driving speed, the decelerated date-update driving speed being slower that the normal date-update driving speed.

20. A method of operating an electronic timepiece corresponding to claim 19 wherein the control unit is responsive to the detected output voltage being greater than a high threshold (V2) voltage and the difference in number of days being less than a threshold number of days for setting the speed of driving of the date unit to the normal date-update driving speed, and the control unit is responsive to the detected output voltage being less than or equal to the high threshold voltage for setting the speed of driving of the date unit to the decelerated date-update driving speed.

21. A method of operating an electronic timepiece corresponding to claim 12 wherein the control unit, upon termination of suspension of the supply of power by the power-saving unit, determines the difference in number of days between the displayed calendar information and the current calendar information and the determined difference comprises the at least one predetermined timepiece condition.

22. A method of operating an electronic timepiece corresponding to claim 21, wherein the control unit is responsive to the difference in number of days being less than a threshold number of days for setting the speed of driving of the date unit to a normal date-update driving speed, and the control unit is responsive to the difference in number of days being greater than the threshold number of days for setting the speed of driving of the date unit to a decelerated date-update driving speed, the decelerated date-update driving speed being slower that the normal date-update driving speed.

23. An electronic timepiece comprising;

a power source;

a power-saving unit that suspends supply of power from the power source under a predetermined power-saving condition;

a hand-driving unit that drives hands that indicate second, minute and hour by receiving power from the power source;

a date unit that indicates displayed calendar information comprising at least one of year, month, and day;

a zero time (0:00) detector that detects a zero time (0:00) position of the hands and outputs a zero time (0:00) detection signal;

a 24 hours-timekeeping unit that counts time and outputs a 24-hours signal as each 24 hour time period elapses;

a reset unit that outputs a reset signal after a system resetting;

a control unit that resets the 24 hours-timekeeping unit following a first zero time (0:00) detection signal following the reset signal;

a date driving unit that drives the date unit, the control unit controlling the date driving unit to drive the date unit and advance the date in response to a first zero time (0:00) detection signal following the reset signal, and thereafter controlling the date driving unit to drive the date unit and advance the date in response to each 24-hours signal.

24. An electronic timepiece according to claim 23, wherein; a precondition of the power-saving unit suspending supply of power from the power source is reception of a first zero time (0:00) detection signal following the reset signal.

25. An electronic timepiece comprising:

a power source;

a power-saving unit that suspends supply of power from the power source under a predetermined power-saving condition;

a hand-driving unit that drives hands that indicate second, minute and hour by receiving power from the power source;

a 24 hours-timekeeping unit that counts time and outputs a 24-hours signal as each 24 hours elapses;

a reset unit that outputs a reset signal and resets the 24 hours-timekeeping unit; and a precondition of the power-saving unit suspending supply of power from the power source is reception of a 24-hours signal following the reset signal.

26. A method of operating an electronic timepiece comprising:

supplying power with a power source;

suspending supply of power from the power source under a predetermined power-saving condition;

driving hands, which indicate second, minute, and hour, with a hand-driving unit by receiving power from the power source;

detecting a zero time (0:00) position of the hands and outputting a zero time (0:00) detection signal;

counting time with a 24 hours-timekeeping unit and outputting a 24-hours signal as each 24 hour time period elapses;

outputting a reset signal;

resetting the 24 hours-timekeeping unit in response to a first zero time (0:00) detection signal following the reset signal;

driving a date unit to advance a date in response to a first zero time (0:00) detection signal following the reset signal, and thereafter driving the date unit to advance the date in response to each 24-hours signal.

27. A method of operating an electronic timepiece according to claim 26, wherein;

a precondition of suspending supply of power from the power source is reception of a first zero time (0:00) detection signal following the reset signal.

28. A method of operating an electronic timepiece comprising:

supplying power with a power source;

suspending supply of power from the power source under a predetermined power-saving condition;

driving hands, which indicate second, minute, and hour, with a hand-driving unit by receiving power from the power source;

counting time with a 24 hours-timekeeping unit and outputting a 24-hours signal as each 24 hour time period elapses;

outputting a reset signal that resets the 24 hours-timekeeping unit;

suspending supply of power from the power source only after reception of a 24-hours signal following the reset signal.

29. An electronic timepiece comprising:

a means for supplying power;

a means for suspending supply of power from the means for supplying power under a predetermined power-saving condition;

a means for driving hands that indicate second, minute and hour by receiving power from the means for supplying power;

a means for indicating displayed calendar information comprising at least one of year, month, and day;

a means for driving the means for indicating displayed calendar information by receiving power from means for supplying power;

a means for updating current calendar information comprising at least one of year, month, and day, while the means for suspending supply of power suspends the supply of power;

a means for controlling that, upon termination of suspension of the supply of power by the means for suspending supply of power, controls the means for driving the means for indicating displayed calendar information to drive the means for indicating displayed calendar information so that the displayed calendar information coincides with the current calendar information, the means for controlling being responsive to at least one predetermined timepiece condition for setting a speed of driving of the means for indicating displayed calendar information.

30. An electronic timepiece corresponding to claim 29 further comprising a means for detecting an output voltage of the power source; and the detected output voltage comprises the at least one predetermined timepiece condition.

31. An electronic timepiece corresponding to claim 30, wherein the means for controlling is responsive to the detected output voltage being greater than a high threshold voltage (V2) for setting the speed of driving of the means for indicating displayed calendar information to a normal date-update driving speed.

32. An electronic timepiece corresponding to claim 30, wherein the means for controlling is responsive to the detected output voltage being less than or equal to a low threshold voltage (V1) for setting the speed of driving of the means for indicating displayed calendar information to zero, thereby prohibiting driving of the means for indicating displayed calendar information.

33. An electronic timepiece corresponding to claim 30, wherein the means for controlling is responsive to the detected output voltage being greater than a high threshold voltage (V2) for setting the speed of driving of the means for indicating displayed calendar information to a normal date-update driving speed, and the means for controlling is responsive to the detected output voltage being less than or equal to a low threshold voltage (V1) for setting the speed of driving of the means for indicating displayed calendar information to zero, thereby prohibiting driving of the means for indicating displayed calendar information, the low threshold voltage being less than the high threshold voltage.

34. An electronic timepiece corresponding to claim 30, wherein the means for controlling is responsive to the detected output voltage being greater than a high threshold (V2) voltage for setting the speed of driving of the means for indicating displayed calendar information to a normal date-update driving speed, and the means for controlling is responsive to the detected output voltage being less than or equal to the high threshold voltage for setting the speed of driving of the means for indicating displayed calendar information to a decelerated date-update driving speed, the decelerated date-update driving speed being slower that the normal date-update driving speed.

35. An electronic timepiece corresponding to claim 30, wherein the means for controlling, upon termination of suspension of the supply of power by the means for suspending supply of power, determines the difference in number of days between the displayed calendar information and the current calendar information and the determined difference comprises another of the at least one predetermined timepiece conditions.

36. An electronic timepiece corresponding to claim 35, wherein the means for controlling is responsive to the difference in number of days being less than a threshold number of days for setting the speed of driving of the means for indicating displayed calendar information to a normal date-update driving speed, and the means for controlling is responsive to the difference in number of days being greater than the threshold number of days for setting the speed of driving of the means for indicating displayed calendar information to a decelerated date-update driving speed, the decelerated date-update driving speed being slower that the normal date-update driving speed.

37. An electronic timepiece corresponding to claim 36 wherein the means for controlling is responsive to the detected output voltage being greater than a high threshold (V2) voltage and the difference in number of days being less than a threshold number of days for setting the speed of driving of the means for indicating displayed calendar information to the normal date-update driving speed, and the means for controlling is responsive to the detected output voltage being less than or equal to the high threshold voltage for setting the speed of driving of the means for indicating displayed calendar information to the decelerated date-update driving speed.

38. An electronic timepiece corresponding to claim 29 wherein the means for controlling, upon termination of suspension of the supply of power by the means for suspending power, determines the difference in number of days between the displayed calendar information and the current calendar information and the determined difference comprises the at least one predetermined timepiece condition.

39. An electronic timepiece corresponding to claim 38, wherein the means for controlling is responsive to the difference in number of days being less than a threshold number of days for setting the speed of driving of the means for indicating displayed calendar information to a normal date-update driving speed, and the means for controlling is responsive to the difference in number of days being greater than the threshold number of days for setting the speed of driving of the means for indicating displayed calendar information to a decelerated date-update driving speed, the decelerated date-update driving speed being slower that the normal date-update driving speed.

40. An electronic timepiece comprising;

a means for supplying power;

a means for suspending supply of power from the means for supplying power under a predetermined power-saving condition;

a means for driving hands that indicate second, minute and hour by receiving power from the means for supplying power;

a means for indicating displayed calendar information comprising at least one of year, month, and day;

a means for detecting a zero time (0:00) position of the hands and for outputting a zero time (0:00) detection signal;

a means for counting time and outputting a 24-hours signal as each 24 hour time period elapses; a means for outputting a reset signal after a system resetting; a means for resetting the means for counting time following a first zero time (0:00) detection signal following the reset signal; a means for driving the means for indicating displayed calendar information, and a means for controlling the means for driving the means for indicating displayed calendar information to drive the means for indicating displayed calendar information and advance the means for indicating displayed calendar information in response to a first zero time (0:00) detection signal following the reset signal, and thereafter controlling the means for driving the means for indicating displayed calendar information to drive the means for indicating displayed calendar information and advance the date in response to each 24-hours signal.

41. An electronic timepiece comprising:

a means for supplying power;

a means for suspending supply of power from the means for supplying power under a predetermined power-saving condition;

a means for driving hands that indicate second, minute and hour by receiving power from the means for supplying power;

a means for counting time and outputting a 24-hours signal as each 24 hour time period elapses;

a means for outputting a reset signal and for resetting the means for counting time;

a precondition of the means for suspending supply of power to suspend the supply of power from the means for supplying power is reception of a 24-hours signal following the reset signal.

* * * * *